US011308839B2

(12) United States Patent
Lin et al.

(10) Patent No.: US 11,308,839 B2
(45) Date of Patent: Apr. 19, 2022

(54) SIGNAL GENERATING CIRCUIT AND DISPLAY DEVICE

(71) Applicant: HannStar Display Corporation, Taipei (TW)

(72) Inventors: Yu-Cheng Lin, Pingtung County (TW); Chien-Ting Chan, Tainan (TW); Chih-Hsuan Lee, Tainan (TW)

(73) Assignee: HannStar Display Corporation, Taipei (TW)

( * ) Notice: Subject to any disclaimer, the term of this patent is extended or adjusted under 35 U.S.C. 154(b) by 0 days.

(21) Appl. No.: 17/089,677

(22) Filed: Nov. 4, 2020

(65) Prior Publication Data

US 2021/0142710 A1 May 13, 2021

(30) Foreign Application Priority Data

Nov. 13, 2019 (CN) ..... 201911108888.X

(51) Int. Cl.
*G09G 3/3266* (2016.01)
*G09G 3/20* (2006.01)

(52) U.S. Cl.
CPC ..... *G09G 3/20* (2013.01); *G09G 2310/0243* (2013.01); *G09G 2310/0281* (2013.01); *G09G 2310/0286* (2013.01); *G09G 2310/0289* (2013.01); *G09G 2320/0247* (2013.01)

(58) Field of Classification Search
CPC ..... G09G 3/3266; G09G 3/3677; G09G 2310/0286; G09G 2310/08; G09G 2310/0243; G09G 2310/0281; G09G 2310/0289; G11C 19/287
See application file for complete search history.

(56) References Cited

U.S. PATENT DOCUMENTS

2015/0102991 A1* 4/2015 Yu ..... G09G 3/3648 345/100
2019/0066562 A1* 2/2019 Hu ..... G11C 19/28
2020/0090611 A1* 3/2020 Han ..... G09G 3/3696

* cited by examiner

*Primary Examiner* — Dennis P Joseph
(74) *Attorney, Agent, or Firm* — CKC & Partners Co., LLC

(57) ABSTRACT

A signal generating circuit for providing signals to a gate driving circuit of a display device is provided. The gate driving circuit has plural shift registers each having a main circuit unit and a discharge circuit unit. The discharge circuit units of at least some of the shift registers are configured to receive a pull-down control signal. The main circuit unit of a first stage shift register of the shift registers is configured to receive a starting signal. The signal generating circuit includes a first circuit unit that is configured to output the pull-down control signal and the starting signal to the gate driving circuit. The starting signal switches from a disabling voltage level to an enabling voltage level at a first time point. The pull-down control signal switches from a disabling voltage level to an enabling voltage level at a second time point before the first time point.

19 Claims, 15 Drawing Sheets

520

520

SIGNAL GENERATING CIRCUIT AND DISPLAY DEVICE

RELATED APPLICATIONS

This application claims priority to Chinese Application Serial Number 201911108888.X filed Nov. 13, 2019, which is herein incorporated by reference.

BACKGROUND

Field of Invention

The present invention relates to a display field, and more particularly to a signal generating circuit that can reset nodes in shift registers beforehand and a display device.

Description of Related Art

A flat panel display device, such as a liquid crystal display (LCD) device or an organic light-emitting diode (OLED) display device, generally has a lot of shift registers for controlling gray levels of all pixels displayed in the display device at the same time point. On the other hand, the accuracy of signals correspondingly outputted at each time point has to be considered in an electrical circuit design of a shift register for ensuring image display quality of a display device with such shift register. However, if the waveforms of the scan signals outputted through the shift registers output have errors, the display device will be caused to display incorrect image data. In addition, if the shift registers is susceptible to noise interference, the display device will be prone to image display problems such as flicker, even causing operate failures of the shift registers.

SUMMARY

The invention is to provide a signal generating circuit and a display device which can reset nodes in shift registers before image display to avoid noise interference that would cause the display device prone to image display problems such as flicker and even cause operate failures of the shift registers.

One aspect of the invention is directed to a signal generating circuit for providing signals to a gate driving circuit of a display device. The gate driving circuit has shift registers. Each shift register has a main circuit unit and a discharge circuit unit. The discharge circuit units of at least some of the shift registers are configured to receive the pull-down control signal. The main circuit unit of a first stage shift register of the shift registers is configured to receive a starting signal. The signal generating circuit includes a first circuit unit that is configured to output the pull-down control signal and the starting signal to the gate driving circuit. The starting signal switches from a disabling voltage level to an enabling voltage level at a first time point, and the pull-down control signal switches from a disabling voltage level to an enabling voltage level at a second time point that is before the first time point.

In one embodiment of the invention, a duration from the first time point to the second time point is greater than or equal to 50 milliseconds and less than or equal to 1 second.

In one embodiment of the invention, the main circuit unit includes a precharge unit and a pull-up unit. The precharge unit outputs a precharge signal to a first node, the pull-up unit is coupled to the precharge unit and receives the precharge signal, the pull-up unit output a scan signal to a second node, and the discharge circuit unit is coupled to the first node and the second node.

In one embodiment of the invention, the display device sequentially displays $1^{st}$ to $M^{th}$ frames after the display device is powered on or restarts, M is an integer greater than or equal to 2, and the second time point is before a time point at which the display device displays the first frame.

In one embodiment of the invention, the gate driving circuit sequentially output a plurality of scan signals in the first frame after the starting signal switches from the disabling voltage level to the enabling voltage level at the first time point.

In one embodiment of the invention, the first circuit unit is further configured to output another pull-down control signal to the gate driving circuit. The discharge circuit units of the odd-numbered stage shift registers of the shift registers and the discharge circuit units of the even-numbered stage shift registers of the shift registers are respectively configured to receive the pull-down control and the another pull-down control signal, or alternatively the discharge circuit units of the even-numbered stage shift registers of the shift registers and the discharge circuit units of the odd-numbered stage shift registers of the shift registers are respectively configured to receive the pull-down control and the another pull-down control signal.

In one embodiment of the invention, the another pull-down control signal is at the disabling voltage level before the first time point.

In one embodiment of the invention, the pull-down control signal and the another pull-down control signal are phase-inverted with respect to each other during a frame of the display device.

In one embodiment of the invention, the discharge circuit unit of each shift register is configured to receive the pull-down control signal.

In one embodiment of the invention, the first circuit unit is configured to further output another pull-down control signal to the gate driving circuit, and the discharge circuit unit of each of the shift registers is configured to receive the another pull-down control signal.

In one embodiment of the invention, the first circuit unit is a level shifter.

In one embodiment of the invention, the signal generating circuit further includes a second circuit unit electrically connected to the first circuit unit. The second circuit unit is configured to output a signal to the first circuit unit. The first circuit unit is configured to convert the signal into the pull-down control signal.

In one embodiment of the invention, the second circuit unit is an inverter.

In one embodiment of the invention, the signal generating circuit further includes a third circuit unit electrically connected to the second circuit unit. The third circuit unit is configured to provide another signal to the second circuit unit. The second circuit unit is configured to convert the another signal into the signal.

In one embodiment of the invention, the third circuit unit is a timing controller.

In one embodiment of the invention, the third circuit unit further provides the another signal to the first circuit unit.

Another aspect of the invention is directed to a display device which includes a substrate, plural scan lines and data lines and a gate driving circuit. The scan lines and the data lines are disposed on the substrate. The gate driving circuit is electrically connected to at least some of the scan lines and includes plural shift registers and a signal generating circuit. Each shift register has a main circuit unit and a discharge circuit unit. The discharge circuit units of at least some of the shift registers are configured to receive a pull-down control signal. The main circuit unit of a first stage shift register of the shift registers is configured to receive a starting signal. The signal generating circuit is electrically connected to the gate driving circuit and includes a first circuit unit that is configured to output the pull-down control signal and the starting signal to the gate driving circuit. The starting signal switches from a disabling voltage level to an enabling voltage level at a first time point, and the pull-down control signal switches from a disabling voltage level to an enabling voltage level at a second time point that is before the first time point.

In one embodiment of the invention, the gate driving circuit is a gate on array (GOA) structure.

BRIEF DESCRIPTION OF THE DRAWINGS

The invention can be more fully understood by reading the following detailed description of the embodiment, with reference made to the accompanying drawings as follows.

DETAILED DESCRIPTION

Specific embodiments of the present invention are further described in detail below with reference to the accompanying drawings, however, the embodiments described are not intended to limit the present invention and it is not intended for the description of operation to limit the order of implementation.

It will be understood that, although the terms "first," "second," and "third" may be used herein to describe various elements, components, areas and/or portions, these elements, components, areas and/or portions, should not be limited by these terms. These terms are only used to distinguish elements, components, areas and/or portions.

Terms used herein are only used to describe the specific embodiments, which are not used to limit the claims appended herewith. Unless limited otherwise, the term "a," "an," "one" or "the" of the single form may also represent the plural form. In addition, the spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Regarding the term "coupled" used in the following description, it may be used to indicate that two or more elements are in direct physical or electrical contact with each other, or may also mean that two or more elements may not be in direct contact with each other. "Coupled" may still be used to indicate that two or more elements cooperate or interact with each other.

Figure 1:
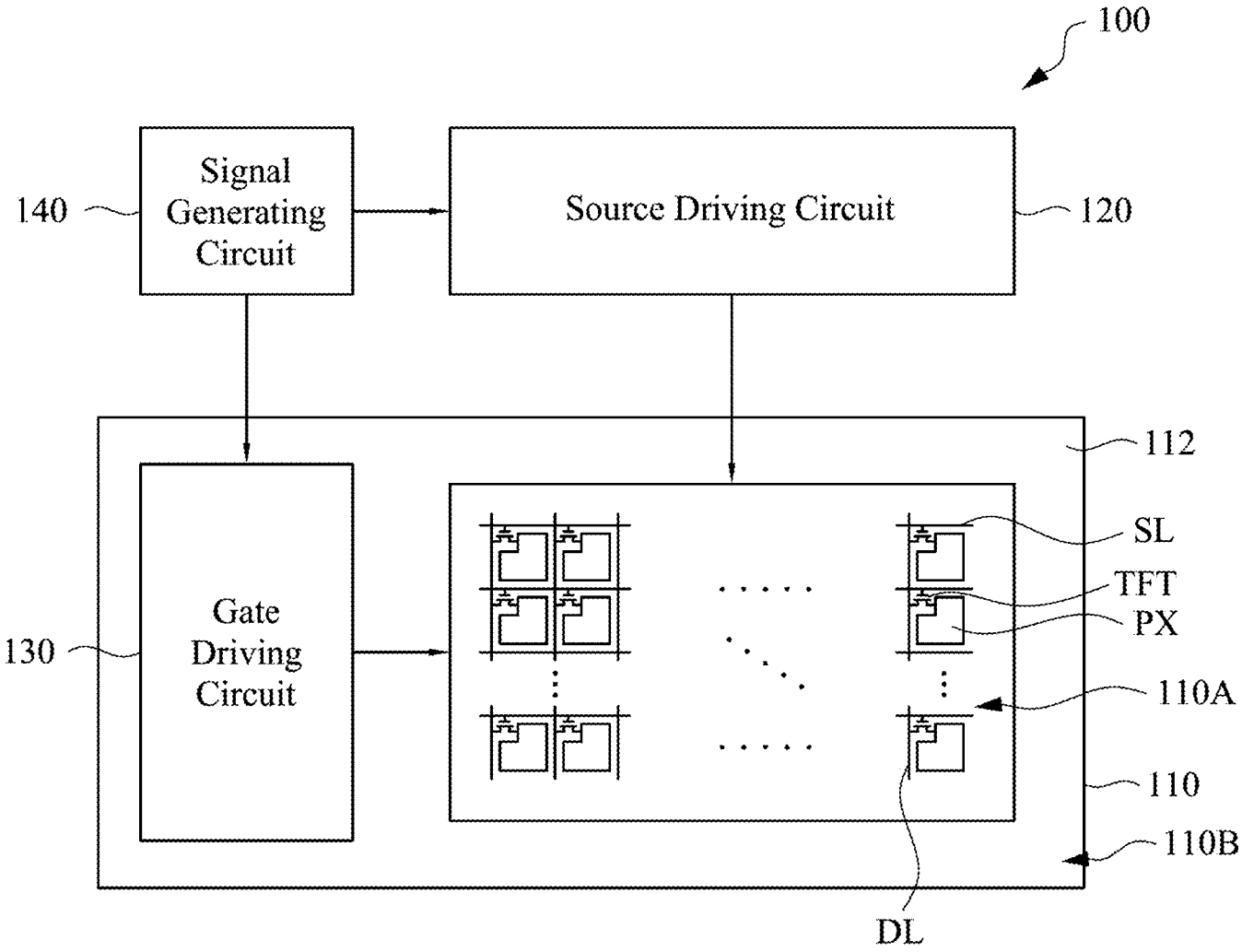
FIG. 1 is a schematic diagram of a display device in accordance with some embodiments of the invention.

Referring to FIG. 1, FIG. 1 is a schematic diagram of a display device 100 in accordance with some embodiments of the invention. The display device 100 includes a display panel 110, a source driving circuit 120, a gate driving circuit 130 and a signal generating circuit 140. The display panel 110 may be, for example, a liquid crystal display (LCD) apparatus of twisted nematic (TN) mode, in-plane switching (IPS) mode, fringe-field switching (FFS) mode, vertical alignment (VA) mode or other different modes, or an organic light-emitting diode (OLED) panel. The source driving circuit 120 is electrically connected to the display panel 110, and is configured to convert image data into source driving signals and transmit the source driving signals to the display panel 110. The gate driving circuit 130 is configured to generate and transmit gate driving signals to the display panel 110. The signal generating circuit 140 is electrically connected to the gate driving circuit 130, and is configured to provide signals associated with scan driving to the gate driving circuit 130, so as to control the gate driving circuit 130 to sequentially drive the scan lines SL in the active area 110A of the display panel 110. In the embodiments, the signal generating circuit 140 is also electrically connected to the source driving circuit 120, and is configured to provide signals associated with data driving to the source driving circuit 120, so as to control the source driving circuit 120 to transmit corresponding image data to the data lines DL in the active area 110A of the display panel 110 when the scan lines SL are sequentially driven. However, the invention is not limited thereto. In another embodiment, the display device 100 further includes another signal generating circuit; the signal generating circuit 140 provides signals to the gate driving circuit 130 and is not electrically connected to the source driving circuit 120, while the another signal generating circuit provides signals associated with data driving to the source driving circuit 120, so as to control the source driving circuit 120 to transmit corresponding image data to the data lines DL in the active area 110A of the display panel 110 when the scan lines SL are sequentially driven.

The display panel 110 has an active area 110A and a peripheral area 1108. In the active area 110A, data lines DL, scan lines SL and pixels PX are formed on the active matrix substrate 112 of the display panel 110, and such pixels PX collectively display an image by the driving of the source driving signals and the gate driving signals. In the peripheral area 1108, wirings (not shown) are respectively coupled to the source driving circuit 120 and the gate driving circuit 130, and are respectively coupled to the data lines DL and the gate lines SL in the active area 110A, so as to respectively send the source driving signals and the gate driving signals to thin film transistors TFT on the active matrix substrate 112 and respectively in the pixels PX, such that the pixels PX display corresponding gray levels in a particular time under the on-off switch control of the thin film transistors TFT.

The display device 100 of the invention may be a system on glass (SOG) panel. That is, in the invention, the gate driving circuit 130 is formed in the display panel 110. As such, the electrical components in the gate driving circuit 130 and in the display panel 110 may be formed simultaneously by the same process or processes. For example, the thin film transistors of the gate driving circuit 130 and the thin film transistors TFT in the active area 110A of the display panel 110 may be formed simultaneously by the same process or processes. In some embodiments, the source driving circuit 120 and/or the signal generating circuit 140 may also be formed in the peripheral area 1108 of the display panel 110, and the electrical components and wirings of the display panel 110, the source driving circuit 120, the gate driving circuit 130 and the signal generating circuit 140 may be formed simultaneously by the same process or processes.

Figure 2:
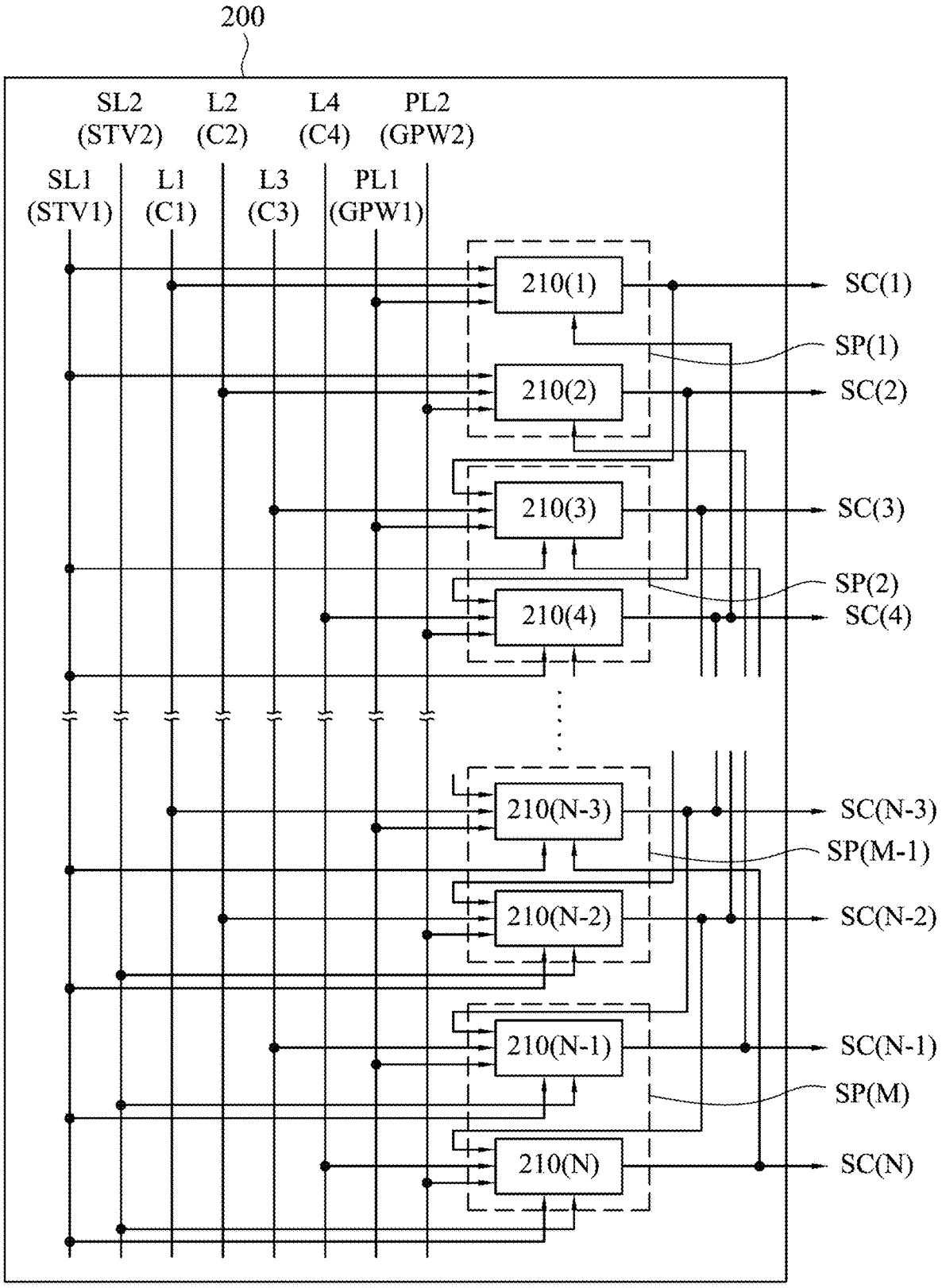
FIG. 2 is a schematic diagram of a gate driving circuit in accordance with some embodiments of the invention.

Referring to FIG. 2, FIG. 2 is a schematic diagram of a gate driving circuit 200 in accordance with some embodiments of the invention. The gate driving circuit 200 may be applied to the display device 100 in FIG. 1 or another similar display device. In the following, the gate driving circuit 200 applied to the display device 100 in FIG. 2 is exemplified for description. The gate driving circuit 200 may be the full or a part of the gate driving circuit 130, and includes $1^{st}$ to $N^{th}$ stage shift registers 210(1)-210(N), where N is an integer greater than or equal to 4. The $1^{st}$ to $N^{th}$ stage shift registers 210(1)-210(N) are a Gate Driver on Array (GOA) structure. Further, N is an even number greater than 4, and the shift registers 210(1)-210(N) sequentially form circuit pairs SP(1)-SP(M) in units of every two neighboring shift registers, where N is two times of M. As can be seen from FIG. 2, the $1^{st}$ and $2^{nd}$ stage shift registers 210(1), 210(2) form the circuit pair SP(1), the $3^{rd}$ and $4^{th}$ stage shift registers 210(3), 210(4) form the circuit pair SP(2), and so on. The coupling relationship between the shift registers for each of the circuit pairs SP(1)-SP(M) will be described in FIGS. 3A-3D.

As shown in FIG. 2, the gate driving circuit 200 further includes a starting signal line SL1, an ending signal line SL2, pull-down control signal lines PL1, PL2 and clock signal lines L1-L4 that are respectively configured to transmit a starting signal STV1, an ending signal STV2, pull-down control signals GPW1, GPW2 and clock signals C1-C4 to the corresponding shift registers. It is noted that the reference characters SL1(STV1), SL2(STV2), L1(C1), L2(C2), L3(C3), L4(C4), PL1(GPW1), PL2(GPW2) in FIG. 2 respectively represent the starting signal line SL1, the ending signal line SL2, the pull-down control signal lines PL1, PL2 and the clock signal lines L1-L4 for transmitting the starting signal STV1, the ending signal STV2, the pull-down control signals GPW1, GPW2 and the clock signals C1-C4. For example, the starting signal line SL1, the ending signal line SL2, the pull-down control signal lines PL1, PL2 and the clock signal lines L1-L4 are coupled to the signal generating circuit 140 that generates the starting signal STV1, the ending signal STV2, the pull-down control signals GPW1, GPW2 and the clock signals C1-C4, such that the starting signal STV1, the ending signal STV2, the pull-down control signals GPW1, GPW2 and the clock signals C1-C4 are transmitted to the corresponding shift registers respectively through the starting signal line SL1, the ending signal line SL2, the pull-down control signal lines PL1, PL2 and the clock signal lines L1-L4. In particular, in a case where N is a multiple of 4, the clock signal line L1 is coupled to the $1^{st}$ stage shift register 210(1), the $5^{th}$ stage shift register 210(5), . . . , and the $(N-3)^{th}$ stage shift register 210(N−3), the clock signal line L2 is coupled to the $2^{nd}$ stage shift register 210(2), the $6^{th}$ stage shift register 210(6), . . . , and the $(N-2)^{th}$ stage shift register 210(N−2), the clock signal line L3 is coupled to the $3^{rd}$ stage shift register 210(3), the $7^{th}$ stage shift register 210(7), . . . , and the $(N-1)^{th}$ stage shift register 210(N−1), and the clock signal line L4 is coupled to the $4^{th}$ stage shift register 210(4), the $8^{th}$ stage shift register 210(8), . . . , and the $N^{th}$ stage shift register 210(N). As such, the clock signal lines L1-L4 respectively provide the clock signals C1-C4 to the corresponding shift registers 210(1)-210(N), such that the clock signals C1-C4 are sequentially and cyclically inputted into the shift registers 210(1)-210(N), where the clock signals C2, C3, C4 respectively lag the clock signals C1, C2, C3 by ¼ clock period.

In addition, the starting signal line SL1 provides the starting signal STV1 to the $1^{st}$ to $N^{th}$ stage shift registers 210(1)-210(N), the ending signal line SL2 provides the ending signal STV2 to the $(N-2)^{th}$ to $N^{th}$ stage shift registers 210(N−2)-210(N), the pull-down control signal line PL1 provides the pull-down control signal GPW1 to the odd-numbered stage shift registers 210(1), 210(3), . . . , 210(N−1), and the pull-down control signal line PL2 provides the pull-down control signal GPW2 to the even-numbered stage shift registers 210(2), 210(4), . . . , 210(N).

The starting signal line SL1, the ending signal line SL2, the pull-down control signal lines PL1, PL2 and the clock signal lines L1-L4 may be coupled to the signal generating circuit 140; that is, the starting signal STV1, the ending signal STV2, the pull-down control signals GPW1, GPW2 and the clock signals C1-C4 may be provided by the signal generating circuit 140, but the invention is not limited to.

In the gate driving circuit 200, the $1^{st}$ to $N^{th}$ stage shift registers 210(1)-210(N) respectively provide $1^{st}$ to $N^{th}$ stage scan signals SC(1)-SC(N) for the corresponding gate lines. Moreover, the $1^{st}$ to $3^{rd}$ stage scan signals SC(1)-SC(3) are respectively inputted to the $3^{rd}$ to $5^{th}$ stage shift registers 210(3)-210(5), the $(N-1)^{th}$ and $N^{th}$ scan signals SC(N−1), SC(N) are respectively inputted to the $(N-4)^{th}$ and $(N-3)^{th}$ stage shift registers 210(N−4), 210(N−3), and each of the $4^{th}$ to $(N-2)^{th}$ stage scan signals SC(4)-SC(N−2) is inputted to the shift registers previous three stage of shift register thereto and next two stage of shift register thereto. For illustration, the $4^{th}$ stage scan signal SC(4) is inputted to the $1^{st}$ and $6^{th}$ shift registers 210(1), 210(6).

Figure 3A:
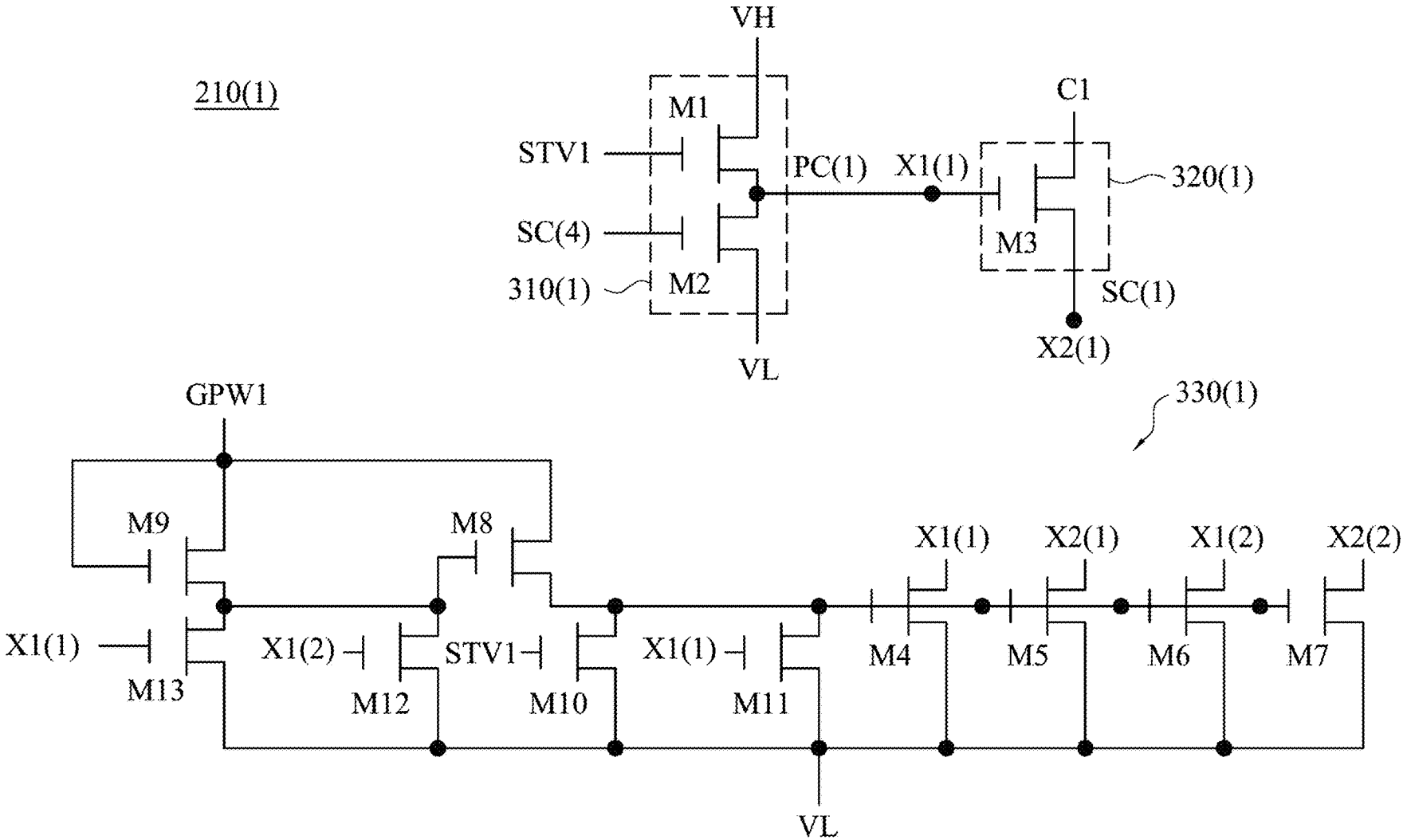
FIG. 3A and FIG. 3B are respective circuit diagrams of the $1^{st}$ stage shift register and the $2^{nd}$ stage shift register in FIG. 2.
Figure 3B:
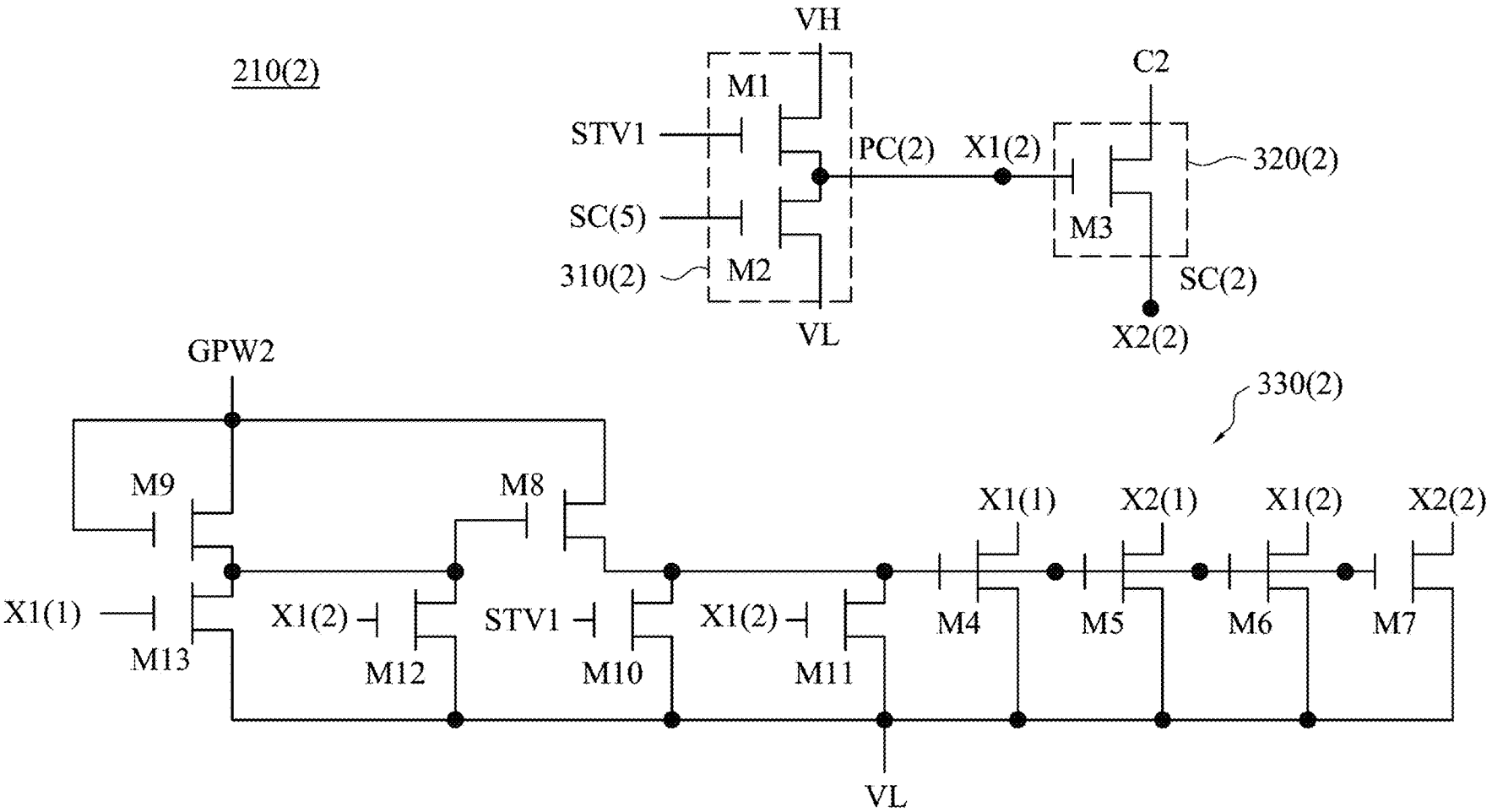

FIG. 3A and FIG. 3B are respective circuit diagrams of the $1^{st}$ stage shift register 210(1) and the $2^{nd}$ stage shift register 210(2) in FIG. 2. As shown in FIG. 3A and FIG. 3B, the $1^{st}$ stage shift register 210(1) includes a precharge unit 310(1), a pull-up unit 320(1) and a pull-down unit 330(1), and the $2^{nd}$ stage shift register 210(2) includes a precharge unit 310(2), a pull-up unit 320(2) and a pull-down unit 330(2).

In the $1^{st}$ stage shift register 210(1) of FIG. 3A, the precharge unit 310(1) receives the starting signal STV1 and the $4^{th}$ stage scan signal SC(4), and outputs a precharge signal PC(1) to the node X1(1) based on the starting signal STV1 and the $4^{th}$ stage scan signal SC(4). The precharge unit 310(1) includes transistors M1, M2. The first terminal of the transistor M1 receives the starting signal STV1, the second terminal of the transistor M1 receives a reference voltage VH, and the third terminal of the transistor M1 is coupled to the node X1(1). The first terminal of the transistor M2 receives the $4^{th}$ stage scan signal SC(4), the second terminal of the transistor M2 receives a reference voltage VL, and the third terminal of the transistor M2 is coupled to the node X1(1). In the embodiment, the reference voltages VH, VL are respectively referred to as relatively high and low voltages. For example, the reference voltages VH, VL may be respectively referred to as a gate high voltage (VGH) and a gate low voltage (VGL), but the invention is not limited thereto. In variant embodiments, the reference voltage VH and the reference voltage VL can be relatively high and low voltages, respectively, and the reference voltage VH is different from VGH and/or the reference voltage VL is different from VGL. In the context, "first terminal," "second terminal" and "third terminal" of the transistor respectively relate to the gate, the source and the drain of the transistor, or alternatively respectively relate to the gate, the drain and the source of the transistor.

In the $1^{st}$ stage shift register 210(1) of FIG. 3A, the pull-up unit 320(1) is coupled to the precharge unit 310(1), receives the precharge signal PC(1) and the clock signal C1, and outputs the scan signal SC(1) to the corresponding gate line via the node X2(1) based on the precharge signal PC(1) and the clock signal C1. The pull-up unit 320(1) includes a transistor M3. The first terminal of the transistor M3 is coupled to the node X1(1), the second terminal of the transistor M3 receives the clock signal C1, and the third terminal of the transistor M3 is coupled to the node X2(1) and outputs the $1^{st}$ stage scan signal SC(1).

In the $1^{st}$ stage shift register 210(1) of FIG. 3A, the pull-down unit 330(1) is coupled to the precharge unit 310(1) and the pull-up unit 320(1), receives the precharge signal PC(1) and the pull-down control signal GPW1, and controls the voltage level of the $1^{st}$ stage scan signal SC(1) based on the precharge signal PC(1) and the pull-down control signal GPW1. The pull-down unit 330(1) includes transistors M4-M13. The second terminal of the transistor M4 receives the reference voltage VL, and the third terminal of the transistor M4 is coupled to the node X1(1). The first terminal of the transistor M5 is coupled to the first terminal of the transistor M4, the second terminal of the transistor M5 receives the reference voltage VL, and the third terminal of the transistor M5 is coupled to the node X2(1). The first terminal of the transistor M6 is coupled to the first terminal of the transistor M4, the second terminal of the transistor M6 receives the reference voltage VL, and the third terminal of the transistor M6 is coupled to the node X1(2) of the $2^{nd}$ stage shift register 210(2). The first terminal of the transistor M7 is coupled to the first terminal of the transistor M4, the second terminal of the transistor M7 receives the reference voltage VL, and the third terminal of the transistor M7 is coupled to the node X2(2) of the $2^{nd}$ stage shift register 210(2). The second terminal of the transistor M8 receives the pull-down control signal GPW1, and the third terminal of the transistor M8 is coupled to the first terminal of the transistor M4. The first terminal and the second terminal of the transistor M9 receive the pull-down control signal GPW1, and the third terminal of the transistor M9 is coupled to the first terminal of the transistor M8. The first terminal of the transistor M10 receives the starting signal STV1, the second terminal of the transistor M10 receives the reference voltage VL, and the third terminal of the transistor M10 is coupled to the first terminal of the transistor M4. The first terminal of the transistor M11 is coupled to the node X1(1), the second terminal of the transistor M11 receives the reference voltage VL, and the third terminal of the transistor M11 is coupled to the first terminal of the transistor M4. The first terminal of the transistor M12 is coupled to the node X1(2) of the $2^{nd}$ stage shift register 210(2), the second terminal of the transistor M12 receives the reference voltage VL, and the third terminal of the transistor M12 is coupled to the first terminal of the transistor M8. The first terminal of the transistor M13 is coupled to the node X1(1), the second terminal of the transistor M13 receives the reference voltage VL, and the third terminal of the transistor M13 is coupled to the first terminal of the transistor M8.

In the $2^{nd}$ stage shift register 210(2) of FIG. 3B, the precharge unit 310(2) receives the starting signal STV1 and the $5^{th}$ stage scan signal SC(5), and outputs a precharge signal PC(2) to the node X1(2) based on the starting signal STV1 and the $5^{th}$ stage scan signal SC(5). The precharge unit 310(2) includes transistors M1, M2. The first terminal of the transistor M1 receives the starting signal STV1, the second terminal of the transistor M1 receives the reference voltage VH, and the third terminal of the transistor M1 is coupled to the node X1(2). The first terminal of the transistor M2 receives the $5^{th}$ stage scan signal SC(5), the second terminal of the transistor M2 receives the reference voltage VL, and the third terminal of the transistor M2 is coupled to the node X1(2).

In the $2^{nd}$ stage shift register 210(2) of FIG. 3B, the pull-up unit 320(2) is coupled to the precharge unit 310(2), receives the precharge signal PC(2) and the clock signal C2, and outputs the scan signal SC(2) to the corresponding gate line via the node X2(2) based on the precharge signal PC(2) and the clock signal C2. The pull-up unit 320(2) includes a transistor M3. The first terminal of the transistor M3 is coupled to the node X1(2), the second terminal of the transistor M3 receives the clock signal C2, and the third terminal of the transistor M3 is coupled to the node X2(2) and outputs the $2^{nd}$ stage scan signal SC(2).

In the $2^{nd}$ stage shift register 210(2) of FIG. 3B, the pull-down unit 330(2) is coupled to the precharge unit 310(2) and the pull-up unit 320(2), receives the precharge signal PC(2) and the pull-down control signal GPW2, and controls the voltage level of the $2^{nd}$ stage scan signal SC(2) based on the precharge signal PC(2) and the pull-down control signal GPW2. The pull-down unit 330(2) includes transistors M4-M13. The second terminal of the transistor M4 receives the reference voltage VL, and the third terminal of the transistor M4 is coupled to the node X1(1) of the $1^{st}$ stage shift register 210(1). The first terminal of the transistor M5 is coupled to the first terminal of the transistor M4, the second terminal of the transistor M5 receives the reference voltage VL, and the third terminal of the transistor M5 is coupled to the node X2(1) of the $1^{st}$ stage shift register 210(1). The first terminal of the transistor M6 is coupled to the first terminal of the transistor M4, the second terminal of the transistor M6 receives the reference voltage VL, and the third terminal of the transistor M6 is coupled to the node X1(2). The first terminal of the transistor M7 is coupled to the first terminal of the transistor M4, the second terminal of the transistor M7 receives the reference voltage VL, and the third terminal of the transistor M7 is coupled to the node X2(2). The second terminal of the transistor M8 receives the pull-down control signal GPW2, and the third terminal of the transistor M8 is coupled to the first terminal of the transistor M4. The first terminal and the second terminal of the transistor M9 receive the pull-down control signal GPW2, and the third terminal of the transistor M9 is coupled to the first terminal of the transistor M8. The first terminal of the transistor M10 receives the starting signal STV1, the second terminal of the transistor M10 receives the reference voltage VL, and the third terminal of the transistor M10 is coupled to the first terminal of the transistor M4. The first terminal of the transistor M11 is coupled to the node X1(2), the second terminal of the transistor M11 receives the reference voltage VL, and the third terminal of the transistor M11 is coupled to the first terminal of the transistor M4. The first terminal of the transistor M12 is coupled to the node X1(2), the second terminal of the transistor M12 receives the reference voltage VL, and the third terminal of the transistor M12 is coupled to the first terminal of the transistor M8. The first terminal of the transistor M13 is coupled to the node X1(1) of the $1^{st}$ stage shift register 210(1), the second terminal of the transistor M13 receives the reference voltage VL, and the third terminal of the transistor M13 is coupled to the first terminal of the transistor M8.

Figure 3C:
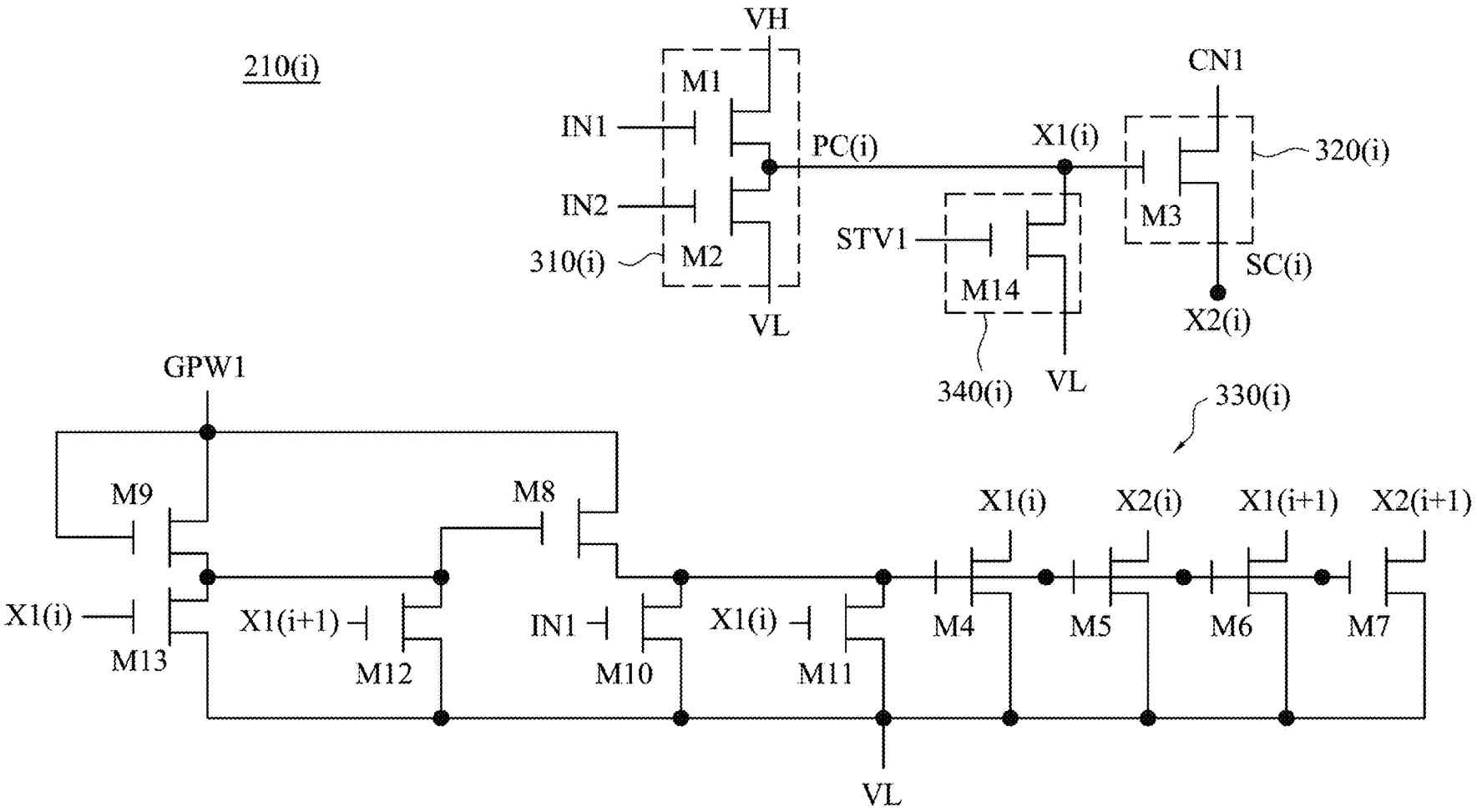
FIG. 3C and FIG. 3D are respective circuit diagrams of the $i^{th}$ stage shift register and the $(i+1)^{th}$ stage shift register in FIG. 2.
Figure 3D:
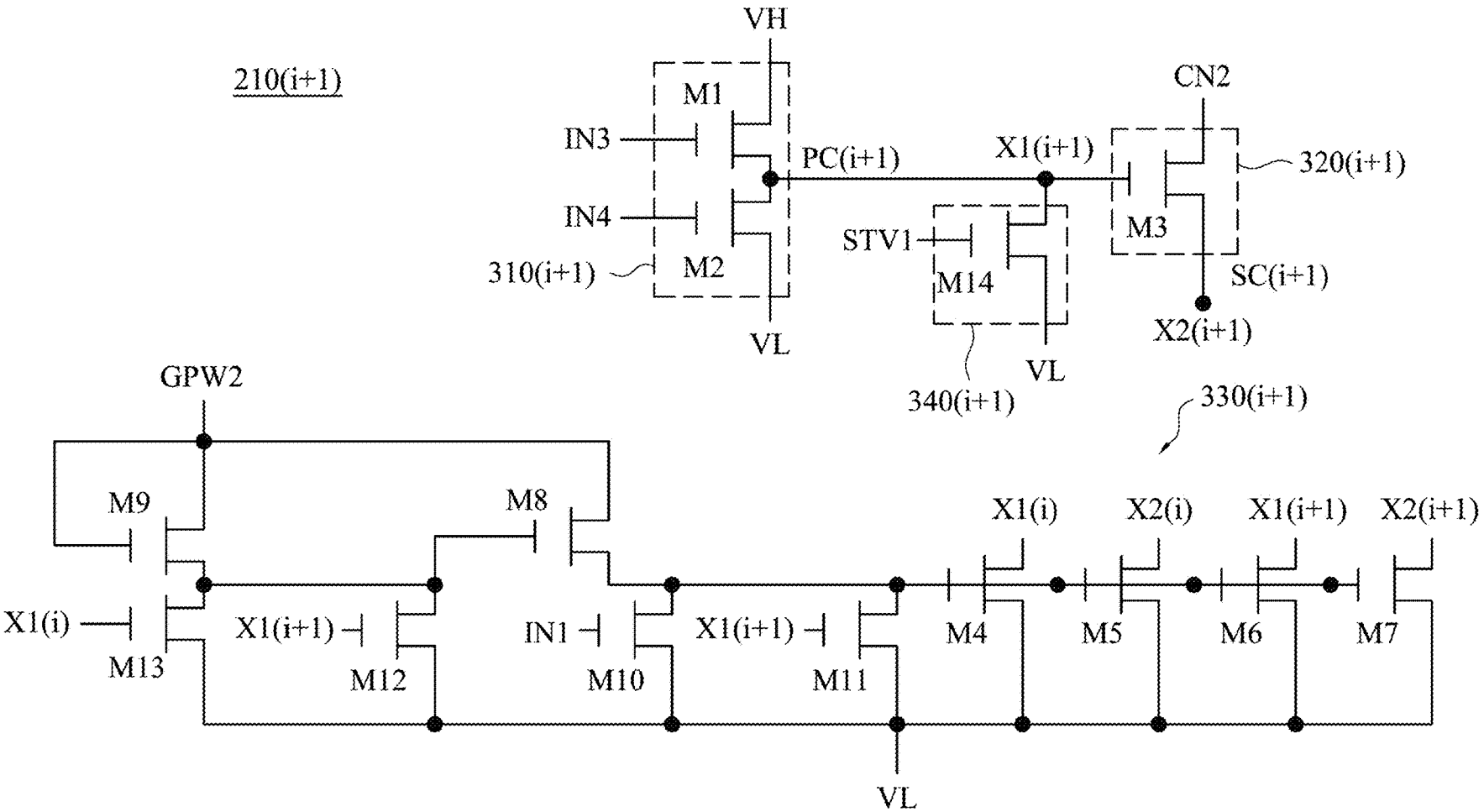

FIG. 3C and FIG. 3D are respective circuit diagrams of the $i^{th}$ stage shift register 210(*i*) and the $(i+1)^{th}$ stage shift register 210(*i*+1) in FIG. 2, where i is an odd integer greater than or equal to 3 and less than or equal to (N−1). As shown in FIG. 3C and FIG. 3D, the $i^{th}$ stage shift register 210(*i*) includes a precharge unit 310(*i*), a pull-up unit 320(*i*), a pull-down unit 330(*i*) and a reset unit 340(*i*), and the $(i+1)^{th}$ stage shift register 210(*i*+1) includes a precharge unit 310(*i*+1), a pull-up unit 320(*i*+1), a pull-down unit 330(*i*+1) and a reset unit 340(*i*+1).

In the $i^{th}$ stage shift register 210(*i*) of FIG. 3C, the precharge unit 310(*i*) receives input signals IN1 and IN2, and outputs a precharge signal PC(i) to the node X1(*i*) based on the input signals IN1 and IN2. The precharge unit 310(*i*) includes transistors M1, M2. The first terminal of the transistor M1 receives the input signal IN1, the second terminal of the transistor M1 receives the reference voltage VH, and the third terminal of the transistor M1 is coupled to the node X1(*i*). The first terminal of the transistor M2 receives the input signal IN2, the second terminal of the transistor M2 receives the reference voltage VL, and the third terminal of the transistor M2 is coupled to the node X1(*i*).

In the $i^{th}$ stage shift register 210(*i*) of FIG. 3C, the pull-up unit 320(*i*) is coupled to the precharge unit 310(*i*), receives the precharge signal PC(i) and the clock signal CN1, and outputs the scan signal SC(i) to the corresponding gate line via the node X2(*i*) based on the precharge signal PC(i) and the clock signal CN1. The pull-up unit 320(*i*) includes a transistor M3. The first terminal of the transistor M3 is coupled to the node X1(*i*), the second terminal of the transistor M3 receives the clock signal CN1, and the third terminal of the transistor M3 is coupled to the node X2(*i*) and outputs the $i^{th}$ stage scan signal SC(i). If (i+1) is a multiple of 4, the clock signal CN1 is the clock signal C3 provided by the clock signal line L3. Oppositely, if (i+1) is not a multiple of 4, the clock signal CN1 is the clock signal C1 provided by the clock signal line L1.

In the $i^{th}$ stage shift register 210(*i*) of FIG. 3C, the pull-down unit 330(*i*) is coupled to the precharge unit 310(*i*) and the pull-up unit 320(*i*), receives the precharge signal PC(i) and the pull-down control signal GPW1, and controls the voltage level of the $i^{th}$ stage scan signal SC(i) based on the precharge signal PC(i) and the pull-down control signal GPW1. The pull-down unit 330(*i*) includes transistors M4-M13. The second terminal of the transistor M4 receives the reference voltage VL, and the third terminal of the transistor M4 is coupled to the node X1(*i*). The first terminal of the transistor M5 is coupled to the first terminal of the transistor M4, the second terminal of the transistor M5 receives the reference voltage VL, and the third terminal of the transistor M5 is coupled to the node X2(*i*). The first terminal of the transistor M6 is coupled to the first terminal of the transistor M4, the second terminal of the transistor M6 receives the reference voltage VL, and the third terminal of the transistor M6 is coupled to the node X1(*i*+1) of the $(i+1)^{th}$ stage shift register 210(*i*+1). The first terminal of the transistor M7 is coupled to the first terminal of the transistor M4, the second terminal of the transistor M7 receives the reference voltage VL, and the third terminal of the transistor M7 is coupled to the node X2(*i*+1) of the $(i+1)^{th}$ stage shift register 210(*i*+1). The second terminal of the transistor M8 receives the pull-down control signal GPW1, and the third terminal of the transistor M8 is coupled to the first terminal of the transistor M4. The first terminal and the second terminal of the transistor M9 receive the pull-down control signal GPW1, and the third terminal of the transistor M9 is coupled to the first terminal of the transistor M8. The first terminal of the transistor M10 receives the input signal IN1, the second terminal of the transistor M10 receives the reference voltage VL, and the third terminal of the transistor M10 is coupled to the first terminal of the transistor M4. The first terminal of the transistor M11 is coupled to the node X1(*i*), the second terminal of the transistor M11 receives the reference voltage VL, and the third terminal of the transistor M11 is coupled to the first terminal of the transistor M4. The first terminal of the transistor M12 is coupled to the node X1(*i*+1) of the $(i+1)^{th}$ stage shift register 210(*i*+1), the second terminal of the transistor M12 receives the reference voltage VL, and the third terminal of the transistor M12 is coupled to the first terminal of the transistor M8. The first terminal of the transistor M13 is coupled to the node X1(*i*), the second terminal of the transistor M13 receives the reference voltage VL, and the third terminal of the transistor M13 is coupled to the first terminal of the transistor M8.

In the $i^{th}$ stage shift register 210(*i*) of FIG. 3C, the reset unit 340(*i*) is coupled to the precharge unit 310(*i*) and the pull-up unit 320(*i*), and resets the voltage levels of the node X1(*i*) (i.e. the precharge signal PC(i)) based on the starting signal STV1. The reset unit 340(*i*) includes a transistor M14. The first terminal of the transistor M14 receives the starting signal STV1, the second terminal of the transistor M14 receives the reference voltage VL, and the third terminal of the transistor M14 is coupled to the node X1(*i*).

In the $(i+1)^{th}$ stage shift register 210(*i*+1) of FIG. 3D, the precharge unit 310(*i*+1) receives the input signals IN3 and IN4, and outputs a precharge signal PC(i+1) to the node X1(*i*+1) based on the input signals IN3 and IN4. The precharge unit 310(*i*+1) includes transistors M1, M2. The first terminal of the transistor M1 receives the input signal IN3, the second terminal of the transistor M1 receives the reference voltage VH, and the third terminal of the transistor M1 is coupled to the node X1(*i*+1). The first terminal of the transistor M2 receives the input signal IN4, the second terminal of the transistor M2 receives the reference voltage VL, and the third terminal of the transistor M2 is coupled to the node X1(*i*+1).

In the $(i+1)^{th}$ stage shift register 210(*i*+1) of FIG. 3D, the pull-up unit 320(*i*+1) is coupled to the precharge unit 310(*i*+1), receives the precharge signal PC(i+1) and the clock signal CN2, and outputs the scan signal SC(i+1) to the corresponding gate line via the node X2(*i*+1) based on the precharge signal PC(i+1) and the clock signal CN2. The pull-up unit 320(*i*+1) includes a transistor M3. The first terminal of the transistor M3 is coupled to the node X1(*i*+1), the second terminal of the transistor M3 receives the clock signal CN2, and the third terminal of the transistor M3 is coupled to the node X2(*i*+1) and outputs the $(i+1)^{th}$ stage scan signal SC(i+1). If (i+1) is a multiple of 4, the clock signal CN2 is the clock signal C4 provided by the clock signal line L4. Oppositely, if (i+1) is not a multiple of 4, the clock signal CN2 is the clock signal C2 provided by the clock signal line L2.

In the $(i+1)^{th}$ stage shift register 210(*i*+1) of FIG. 3D, the pull-down unit 330(*i*+1) is coupled to the precharge unit 310(*i*+1) and the pull-up unit 320(*i*+1), receives the precharge signal PC(i+1) and the pull-down control signal GPW2, and controls the voltage level of the $(i+1)^{th}$ stage scan signal SC(i+1) based on the precharge signal PC(i+1) and the pull-down control signal GPW2. The pull-down unit 330(*i*+1) includes transistors M4-M13. The second terminal of the transistor M4 receives the reference voltage VL, and the third terminal of the transistor M4 is coupled to the node X1(*i*) of the $i^{th}$ stage shift register 210(*i*). The first terminal of the transistor M5 is coupled to the first terminal of the transistor M4, the second terminal of the transistor M5 receives the reference voltage VL, and the third terminal of the transistor M5 is coupled to the node X2(*i*) of the $i^{th}$ stage shift register 210(*i*). The first terminal of the transistor M6 is coupled to the first terminal of the transistor M4, the second terminal of the transistor M6 receives the reference voltage VL, and the third terminal of the transistor M6 is coupled to the node X1(*i*+1). The first terminal of the transistor M7 is coupled to the first terminal of the transistor M4, the second terminal of the transistor M7 receives the reference voltage VL, and the third terminal of the transistor M7 is coupled to the node X2(*i*+1). The second terminal of the transistor M8 receives the pull-down control signal GPW2, and the third terminal of the transistor M8 is coupled to the first terminal of the transistor M4. The first terminal and the second terminal of the transistor M9 receive the pull-down control signal GPW2, and the third terminal of the transistor M9 is coupled to the first terminal of the transistor M8. The first terminal of the transistor M10 receives the input signal IN1, the second terminal of the transistor M10 receives the reference voltage VL, and the third terminal of the transistor M10 is coupled to the first terminal of the transistor M4. The first terminal of the transistor M11 is coupled to the node X1(*i*+1), the second terminal of the transistor M11 receives the reference voltage VL, and the third terminal of the transistor M11 is coupled to the first terminal of the transistor M4. The first terminal of the transistor M12 is coupled to the node X1(*i*+1), the second terminal of the transistor M12 receives the reference voltage VL, and the third terminal of the transistor M12 is coupled to the first terminal of the transistor M8. The first terminal of the transistor M13 is coupled to the node X1(*i*) of the $i^{th}$ stage shift register 210(*i*), the second terminal of the transistor M13 receives the reference voltage VL, and the third terminal of the transistor M13 is coupled to the first terminal of the transistor M8.

In the $(i+1)^{th}$ stage shift register 210(*i*+1) of FIG. 3D, the reset unit 340(*i*+1) is coupled to the precharge unit 310(*i*+1) and the pull-up unit 320(*i*+1), receives the starting signal STV1, and resets the voltage level of the node X1(*i*+1) based on the starting signal STV1. The reset unit 340(*i*+1) includes a transistor M14. The first terminal of the transistor M14 receives the reset signal STV1, the second terminal of the transistor M14 receives the reference voltage VL, and the third terminal of the transistor M14 is coupled to the node X1(*i*+1). It is noted that in one variant embodiment, a reset signal different from the starting signal STV1 is provided to the gate driving circuit 200, the first terminal of the transistor M14 in each of the reset units 340(*i*), 340(*i*+1) receives the reset signal, and the reset units 340(*i*), 340(*i*+1) reset the nodes X1(*i*) thereof based on the reset signal. In another variant embodiment, the $i^{th}$ and $(i+1)^{th}$ stage shift registers 210(*i*), 210(*i*+1) may not have the reset units 340(*i*), 340(*i*+1). In the above two embodiments, the starting signal line SL1 may only provide the starting signal STV1 to the $1^{st}$ and $2^{nd}$ stage shift registers 210(1), 210(2) but not provide the starting signal STV1 to the other shift registers, but the invention is not limited thereto.

If i is an odd integer greater than or equal to 3 and less than or equal to (N−5), then the input signals IN1-IN4 of the $i^{th}$ and $(i+1)^{th}$ stage shift registers 210(*i*), 210(*i*+1) are respectively the $(i-2)^{th}$ stage scan signal SC(i−2), the $(i+3)^{th}$ stage scan signal SC(i+3), the $(i-1)^{th}$ stage scan signal SC(i−1) and the $(i+4)^{th}$ stage scan signal SC(i+4). If the shift register 210(*i*) is the $(N-3)^{th}$ stage shift register 210(N−3), then the input signals IN1-IN4 are respectively the $(N-5)^{th}$ stage scan signal SC(N−5), the $N^{th}$ stage scan signal SC(N), the $(N-4)^{th}$ stage scan signal SC(N−4) and the ending signal STV2, respectively. If the shift register 210(*i*) is the $(N-1)^{th}$ stage shift register 210(N−1), then the input signals IN1-IN4 are respectively the $(N-3)^{th}$ stage scan signal SC(N−3), the ending signal STV2, the $(N-2)^{th}$ stage scan signal SC(N−2) and the ending signal STV2.

In FIGS. 3A-3D, the transistors M1-M14 may be amorphous silicon thin-film transistors, low temperature polysilicon (LTPS) thin-film transistors, indium gallium zinc oxide (IGZO) thin-film transistors, or other suitable thin-film transistors. The main circuit unit of each of the shift registers 210(1)-210(N) includes a precharge unit and a pull-up unit, and the discharge circuit unit of each of the shift registers 210(1)-210(N) includes a pull-down unit. For example, in the shift register 210(1), the main circuit unit includes a precharge unit 310(1) and a pull-up unit 320(1), and the discharge unit includes a pull-down unit 330(1).

Figure 4:
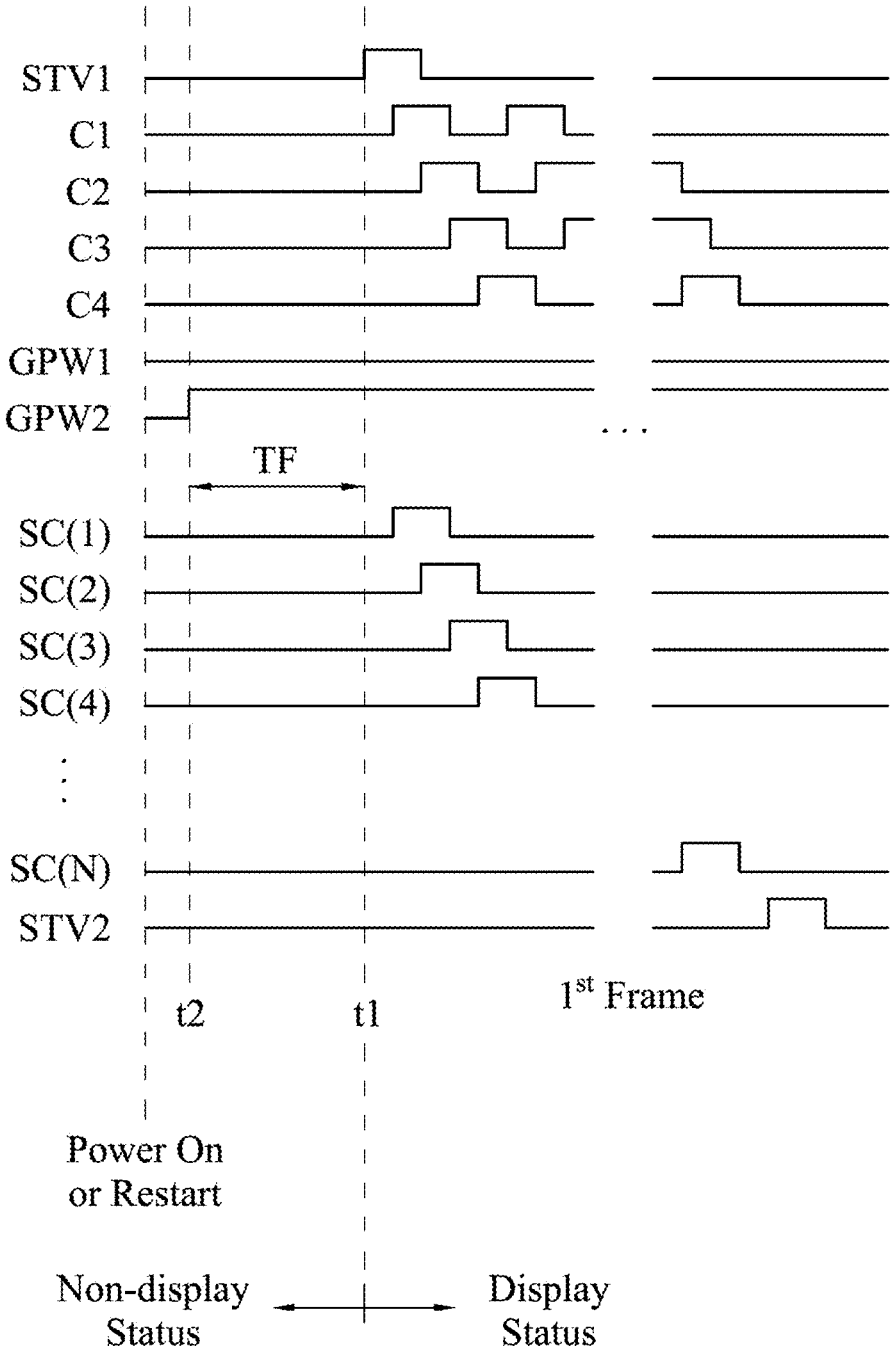
FIG. 4 is an exemplary example of a timing sequence diagram of the gate driving circuit in FIG. 2.

FIG. 4 is an exemplary example of a timing sequence diagram of the gate driving circuit 200 in FIG. 2. It is noted the in the embodiment, the disabling voltage level and the enabling voltage level are respectively a low voltage level and a high voltage level, but the invention is not limited thereto. In another embodiment, the disabling voltage level and the enabling voltage level may be respectively a low voltage level and a high voltage level if the transistors in the circuits of the shift register includes P-type transistors. The following will take the disabling voltage level and the enabling voltage level as respectively low and high voltage levels for illustrative examples, and the embodiments of which the disabling voltage level and the enabling voltage level are respectively high and low voltage levels may be deduced by analogy and are not repeated herein. As shown in FIG. 4, before the display device 100 enters a display status from a non-display status, i.e., before the starting signal STV1 switches from the disabling voltage level to the enabling voltage level (from the low voltage level to the high voltage level) in the first frame period, the pull-down control signal GPW2 switches from the disabling voltage level to the enabling voltage level (from the low voltage level to the high voltage level) beforehand for turning on the transistors M4-M9 in the pull-down units 330(2), 330(4), . . . , 330(N) of the even-numbered shift registers 210(2), 210(4), . . . , 210(N), so as to reset the voltage levels of the nodes X1(1)-X1(N), X2(1)-X2(N) in the shift registers 210(1)-210(N), i.e., set the nodes X1(1)-X1(N), X2(1)-X2(N) of the shift register 210(1)-210(N) to be at the disabling voltage level (the low voltage level). In other words, as shown in FIG. 4, the starting signal STV1 switches from the disabling voltage level to the enabling voltage level at the first time point t1 in the first frame period after the display device enters the display status from the non-display status. Before a second time point t2, the pull-down control signals GPW1, GPW2 are all at the disabling voltage level. At the second time point t2, the pull-down control signal GPW2 switches from the disabling voltage level to the enabling voltage level, while the pull-down control signal GPW1 remains at the disabling voltage level. The duration TF from the predetermined time point (e.g. the second time point t2) at which the pull-down control signal GPW2 switches from the disabling voltage level to the high voltage level to the time point (e.g. the first time point t1) at which the display device 100 enters the first frame period from the non-display status (e.g. the time point at which the starting signal STV1 switches from the disabling voltage level to the enabling voltage level) is greater than or equal to 50 milliseconds and less than or equal to 1 second, such that the voltage levels of the nodes X1(1)-X1(N), X2(1)-X2(N) in the shift registers 210(1)-210(N) have enough time to be set at the disabling voltage level. Furthermore, in some embodiments, the duration TF is greater than or equal to 50 milliseconds and less than or equal to 200 milliseconds, and is preferably greater than or equal to 50 milliseconds and less than or equal to 100 milliseconds. However, the duration TF is not limited thereto in this invention. Then, after the display device 100 enters the display status from the non-display status, the pull-down control signals GPW1, GPW2 respectively remain at the disabling voltage level and the enabling voltage level, and the gate driving circuit 200 starts to output the $1^{st}$ to $N^{th}$ stage scan signals SC(1)-SC(N). During the first frame period, the starting signal STV1 switches from the disabling voltage level to the enabling voltage level, and then the clock signals C1-C4 sequentially switch from the disabling voltage level to the enabling voltage level, such that the $1^{st}$ to $4^{th}$ stage scan signals SC(1)-SC(4) correspondingly switch from the disabling voltage level to the enabling voltage level, and then the clock signals C1-C4 sequentially switch from the enabling voltage level to the disabling voltage level, such that the $1^{st}$ to $4^{th}$ stage scan signals SC(1)-SC(4) correspondingly switch from the enabling voltage level to the disabling voltage level. The clock period of the clock signals C1-C4 is defined as T, and in one clock period T, the durations of the enabling voltage level and the disabling voltage level are both T/2. The clock signals C2, C3, C4 respectively lag the clock signals C1, C2, C3 by ¼ clock period (i.e. T/4). The $5^{th}$ to $N^{th}$ stage scan signals SC(5)-SC(N) sequentially switch from the disabling voltage level to the enabling voltage level and then sequentially switch the enabling voltage level to the disabling voltage level after a certain time in a similar manner based on the abovementioned description, so as to respectively drive the corresponding pixels in the active area 110A of the display panel 110. In the first frame period, data inputting completes after the ending signal STV2 switches from the disabling voltage level to the enabling voltage level and then switches from the enabling voltage level to the disabling voltage level after a certain time. The timing sequences of the starting signal STV1, the ending signal STV2, the clock signals C1-C4 and the $1^{st}$ to $N^{th}$ stage scan signals SC(1)-SC(N) in each of the second or later frame periods are similar to those in the first frame period. In other words, the display device 100 sequentially displays $1^{st}$ to $M^{th}$ frames after the display device 100 is powered on or restarts, M is an integer greater than or equal to 2, the starting signal STV1 in the first frame switches from a disabling voltage level to an enabling voltage level at a first time point t1, the gate driving circuit 130 sequentially outputs the $1^{st}$ to $N^{th}$ stage scan signals SC(1)-SC(N) in the first frame after the starting signal STV1 switches from the disabling voltage level to the enabling voltage level at the first time point t1, the pull-down control signal GPW2 switches from a disabling voltage level to an enabling voltage level at a second time point t2 that is before the first time point t1, and the second time point t2 is before the time point at which the display device displays the first frame. The pull-down control signals GPW1, GPW2 are phase-inverted with respect to each other during each frame period. For example, as shown in FIG. 4, the pull-down control signals GPW1, GPW2 in the first frame period are respectively at the disabling voltage level and the enabling voltage level. The pull-down control signals GPW1, GPW2 may periodically switch the voltage levels thereof. In one embodiment, the signal period of the pull-down control signals GPW1, GPW2 is 2 seconds, and the durations of the enabling voltage level and the disabling voltage level in the signal period are all 1 second.

Figure 5:
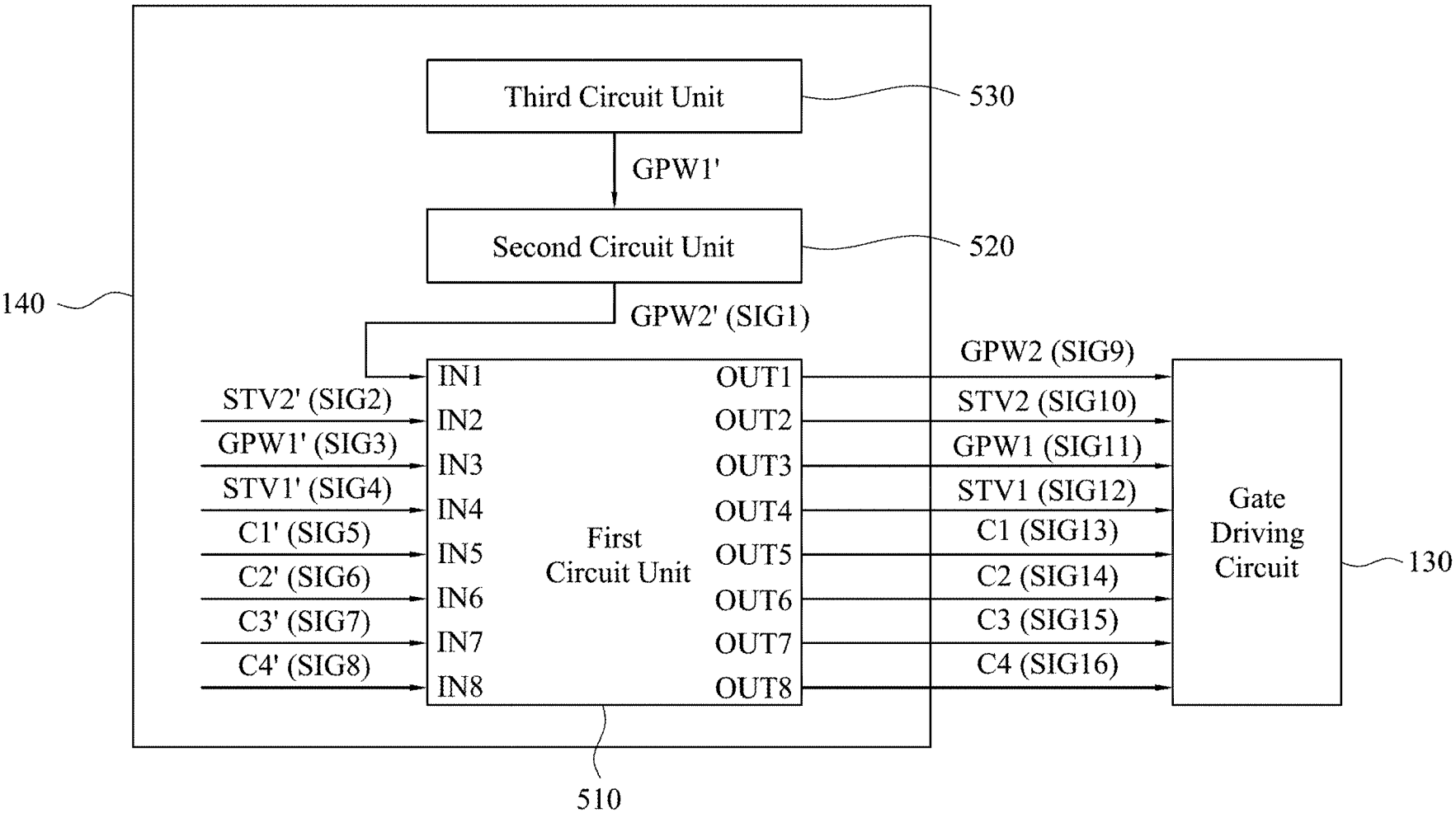
FIG. 5 is a schematic diagram of the gate driving circuit and the signal generating circuit in FIG. 1.

FIG. 5 is a schematic diagram of the gate driving circuit 130 and the signal generating circuit 140 in FIG. 1. As shown in FIG. 5, the signal generating circuit 140 includes a first circuit unit 510, a second circuit unit 520 and a third circuit unit 530. The first circuit unit 510 includes $1^{st}$ to $8^{th}$ input terminals IN1-IN8 and $1^{st}$ to $8^{th}$ output terminals OUT1-OUT8, in which the $1^{st}$ to $8^{th}$ input terminals IN1-IN8 respectively correspond to the $1^{st}$ to $8^{th}$ output terminals OUT1-OUT8. The $1^{st}$ to $8^{th}$ input terminals IN1-IN8 of the first circuit unit 510 respectively receive $1^{st}$ to $8^{th}$ signals SIG1-SIG8, the $1^{st}$ to $8^{th}$ output terminals OUT1-OUT8 respectively output $9^{th}$ to $16^{th}$ signals SIG9-SIG16, and the $1^{st}$ to $8^{th}$ signals SIG1-SIG8 respectively correspond to the $9^{th}$ to $16^{th}$ signals SIG9-SIG16. That is, the $1^{st}$ to $8^{th}$ signals SIG1-SIG8 are inputted into the first circuit unit 510 to correspondingly generate the $9^{th}$ to $16^{th}$ signals SIG9-SIG16.

The first circuit unit 510 may be a level shifter used to adjust the voltage levels of at least some input signals for the gate driving circuit 130 to work normally. For example, as shown in FIG. 5, when the $5^{th}$ to $8^{th}$ input terminals IN5-IN8 respectively receive four clock signals C1'-C4' with logic levels, the first circuit unit 510 converts the clock signals C1'-C4' into the clock signals C1-C4 that swing between a gate high voltage (VGH) and a gate low voltage (VGL), and the clock signals C1-C4 are outputted to the gate driving circuit 130 respectively through the $5^{th}$ to $8^{th}$ output terminals OUTS-OUTS.

As shown in FIG. 4, when the display device 100 is powered-on and in the non-display period, or when the display device 100 enters the restart mode from the sleep mode and in the non-display period, in order to reset the nodes X1(1)-X1(N), X2(1)-X2(N) in the shift registers 210(1)-210(N) after the display device 100 is powered on or restarts and before the display device 100 displays a first frame, the time point t2 at which the pull-down control signal GPW2 switches from the disabling voltage level to the enabling voltage level has to be prior to the time point t1 at which the starting signal STV1 switches from the disabling voltage level to the enabling voltage level during the first frame period. In the embodiment, the first input terminal IN1 of the first circuit unit 510 is a triggering signal input terminal of the first circuit unit 510. That is, the $1^{st}$ signal SIG1 received through the first input terminal IN1 is an triggering signal of the first circuit unit 510, such that the first circuit unit 510 outputs the $9^{th}$ to $16^{th}$ signals SIG9-SIG16 after the $1^{st}$ signal SIG1 is triggered (enabled). As a result, in order to set the starting signal STV1 in the first frame to switch from the disabling voltage level to the enabling voltage level after the pull-down control signal GPW2 switches from the disabling voltage level to the enabling voltage level, the first input terminal IN1 of the first circuit unit 510 may be configured to receive the pull-down control signal GPW2' that is not yet processed by the first circuit unit 510, and the pull-down control signal GPW2 may be correspondingly outputted through the $1^{st}$ output OUT1, while one of the $2^{nd}$ to $8^{th}$ input terminals IN2-IN8 is configured to receive the starting signal STV1' that is not yet processed by the first circuit unit 510, and one of the $2^{nd}$ to $8^{th}$ output terminals OUT2-OUT8 correspondingly outputs the starting signal STV1. As shown in FIG. 5, in the embodiment, the signals (i.e. the $1^{st}$ to $8^{th}$ signals) received through the $1^{st}$ to $8^{th}$ input terminals IN1-IN8 are the pull-down control signal GPW2', the starting signal STV1', the pull-down control signal GPW1', the ending signal STV2' and the clock signals C1'-C4', respectively, and the signals (i.e. the $9^{th}$ to $16^{th}$ signals) outputted through the $1^{st}$ to $8^{th}$ output terminals OUT1-OUT8 are the pull-down control signal GPW2, the starting signal STV1, the pull-down control signal GPW1, the ending signal STV2 and the clock signals C1-C4, respectively. It is noted that in order to distinguish the signals received by the first circuit unit 510 from the signals that are outputted after the process of the circuits in the first circuit unit 510, the signals GPW1', GPW2', STV1', STV2', C1'-C4' received by the first circuit unit 510 may also be referred to as the first pull-down control signal GPW1', GPW2', the first starting signal STV1', the first ending signal STV2' and the first clock signals C1'-C4', while the signals GPW1, GPW2, STV1, STV2 and C1-C4 outputted by the first circuit unit 510 may also be referred to as the second pull-down control signals GPW1, GPW2, the second starting signal STV1, the second ending signal STV2 and the second clock signals C1-C4. For example, the signal levels of the first pull-down control signals GPW1', GPW2', the first starting signal STV1', the first ending signal STV2' and the first clock signals C1'-C4' are logic levels, the first circuit unit 510 converts these signals into the second pull-down control signals GPW1, GPW2, the second starting signal STV1, the second ending signal STV2 and the second clock signals C1-C4, and at least some of the second pull-down control signals GPW1, GPW2, the second starting signal STV1, the second ending signal STV2 and the second clock signals C1-C4 swing between the gate high voltage VGH and the gate low voltage VGL.

As shown in FIG. 5, the third circuit unit 530 provides the pull-down control signal GPW1' to the second circuit unit 520, and the second circuit unit 520 converts the pull-down control signal GPW1' into the pull-down control signal GPW2' and provides the pull-down control signal GPW2' to the first circuit unit 510. In addition, the pull-down control signal GPW1', the starting signal STV1', the ending signal STV2' and the clock signals C1'-C4' received by the first circuit unit 510 may also be provided by the third circuit unit 530 (not shown in FIG. 5). The third circuit unit 530 may be a timing controller that provides signals related to data driving to the source driving circuit 120 and provides signals related to scan driving to the first circuit unit 510, and the first circuit unit 510 adjusts the voltage levels of at least some of the signals related to scan driving for the gate driving circuit 130. In general, after the display device 100 is powered-on or restarts and before the display device 100 displays the first frame, the signals at the input terminals and the output terminals of the timing controller are all at the disabling voltage level in a time duration between the time point at which the display device 100 is powered on or restarts and the time point at which the display device 100 displays the first frame, and therefore, the second circuit unit 520 converts the pull-down control signal GPW1' with the disabling voltage level into the pull-down control signal GPW2' with the enabling voltage level, and the first circuit unit 510 receives the pull-down control signal GPW2' and outputs the pull-down control signal GPW2, such that when the display device 100 is powered on or enters into the restart node from the sleep mode, the time point at which the pull-down control signal GPW2 switches from the disabling voltage level to the enabling voltage level is before that at which the starting signal STV1 switches from the disabling voltage level to the enabling voltage level in the first frame period. Therefore, after the display device 100 is powered on or enters into the restart node from the sleep mode, the nodes X1(1)-X1(N), X2(1)-X2(N) in the shift registers 210(1)-210(N) may be reset before the display device 100 displays the first frame.

Figure 6:
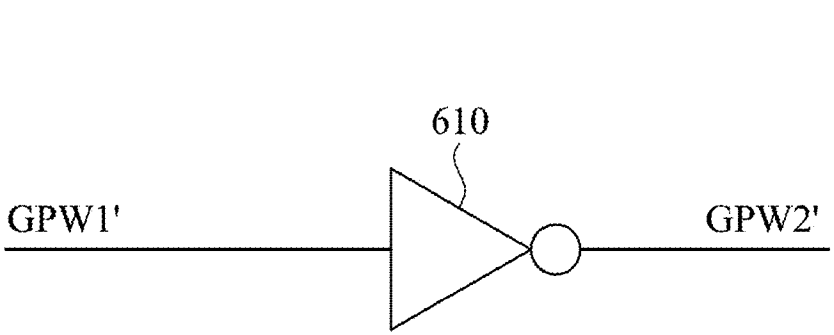
FIG. 6 illustrates one embodiment of the second circuit unit in FIG. 5.

FIG. 6 illustrates one embodiment of the second circuit unit 520 in FIG. 5. As shown in FIG. 6, the second circuit unit 520 includes an inverter 610 that is used to invert the waveform of the pull-down control signal GPW1' to generate the pull-down control signal GPW2'. Therefore, when the voltage of the pull-down control signal GPW1' inputted into the second circuit unit 520 is a disabling voltage level, the voltage of the pull-down control signal GPW2' outputted by the second circuit unit 520 is an enabling voltage level. As described previously, after the display device 100 is powered-on or restarts and before the display device 100 displays the first frame, the signals at the input terminals and the output terminals of the timing controller (the third circuit unit 530) are all at the disabling voltage level in a time duration between the time point at which the display device 100 is powered on or restarts and the time point at which the display device 100 displays the first frame. Therefore, after the display device 100 is powered on or restarts and before the display device 100 displays the first frame, the third circuit unit 530 outputs the pull-down control signal GPW1' with the disabling voltage level, the inverter 610 converts the pull-down control signal GPW1' with the disabling voltage level into the pull-down control signal GPW2' with the enabling voltage level, and then the first circuit unit 510 converts the pull-down control signal GPW2' into the pull-down control signal GPW2, and outputs the pull-down control signal GPW2 to reset the nodes X1(1)-X1(N), X2(1)-X2(N) in the shift registers 210(1)-210(N) before the display device 100 enters the display status. The inverter 610 may be a CMOS inverter, a PMOS inverter, an NMOS inverter, or another suitable circuit.

Figure 7A:
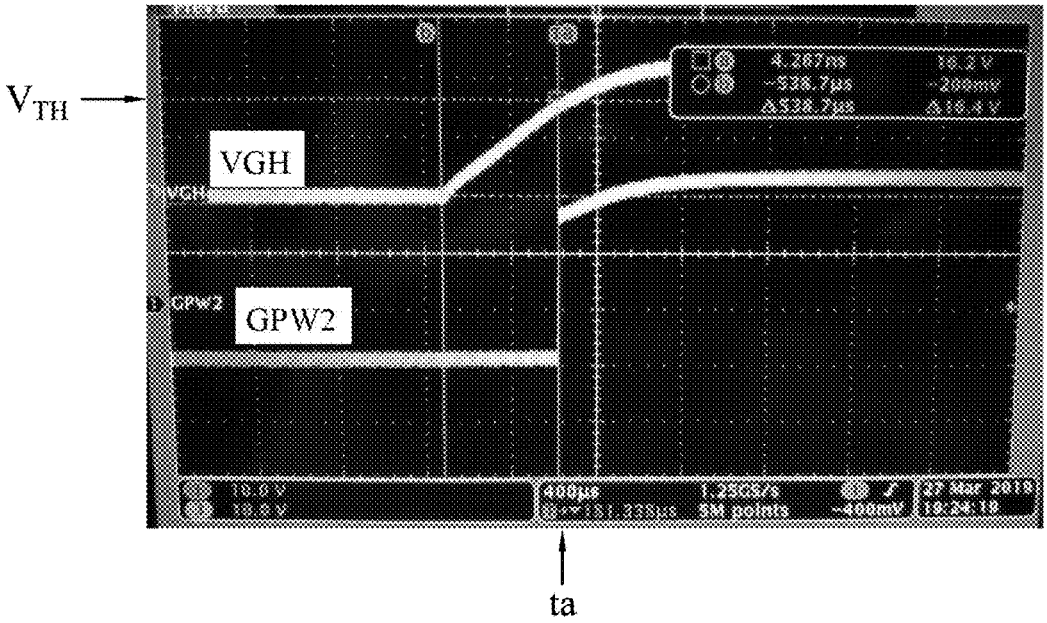
FIG. 7A shows waveforms of the gate high voltage and the pull-down control signal of the first circuit unit during power-on of the display device in FIG. 1.
Figure 7B:
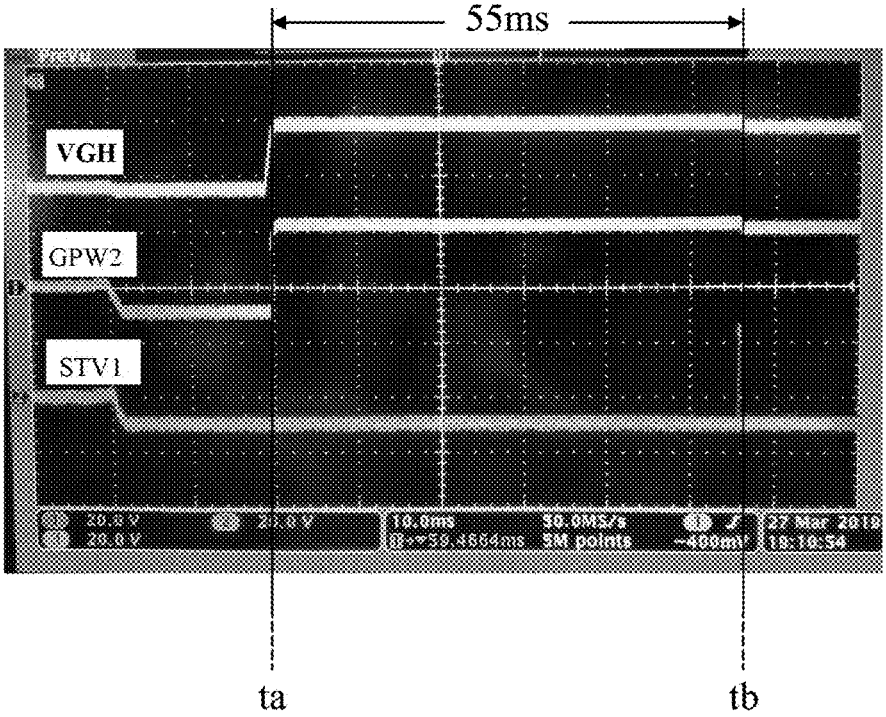
FIG. 7B shows waveforms of the gate high voltage, the pull-down control signal and the starting signal of the first circuit unit during power-on of the display device in FIG. 1.

FIG. 7A shows waveforms of the gate high voltage VGH and the pull-down control signal GPW2 of the first circuit unit 510 after the display device 100 is powered on, and FIG. 7B shows waveforms of the gate high voltage VGH, the pull-down control signal GPW2 and the starting signal STV1 of the first circuit unit 510 after the display device 100 is powered on. As described previously, the first circuit unit 510 may be a level shifter used to adjust the voltage levels of at least some input signals for the gate driving circuit 130 to work normally (e.g., convert the input signals with logic levels into the signals that swing between the gate high voltage VGH and the gate low voltage VGL) and output the signals to the gate driving circuit 130. As shown in FIG. 7A, the gate high voltage VGH gradually rises to a predetermined voltage level after the display device 100 is powered on, and the pull-down control signal GPW2 outputted by the first circuit unit 510 rises from a low voltage level to a high voltage level when the gate high voltage VGH rises to the threshold voltage $V_{TH}$ at the time point ta before the time point at which the gate high voltage VGH reaches the predetermined level. That is, the pull-down control signal GPW2 switches from the disabling voltage level to the enabling voltage level at the time ta. The threshold voltage $V_{TH}$ is between 0 V and the predetermined level of the gate high voltage VGH. For example, the threshold voltage $V_{TH}$ may be 16 V, but the invention is not limited thereto. As shown in FIG. 7B, in the first frame period, the starting signal STV1 switches from the disabling voltage level to the enabling voltage level at the time point tb, and the duration from the time point ta at which the pull-down control signal GPW2 switches from the disabling voltage level to the enabling voltage level to the time point tb at which the starting signal STV1 switches from the disabling voltage level to the enabling voltage level in the first frame period is 55 milliseconds, such that the nodes X1(1)-X1(N), X2(1)-X2(N) of the shift registers 210(1)-210(N) have enough time to be set to be the disabling voltage level.

Figure 8:
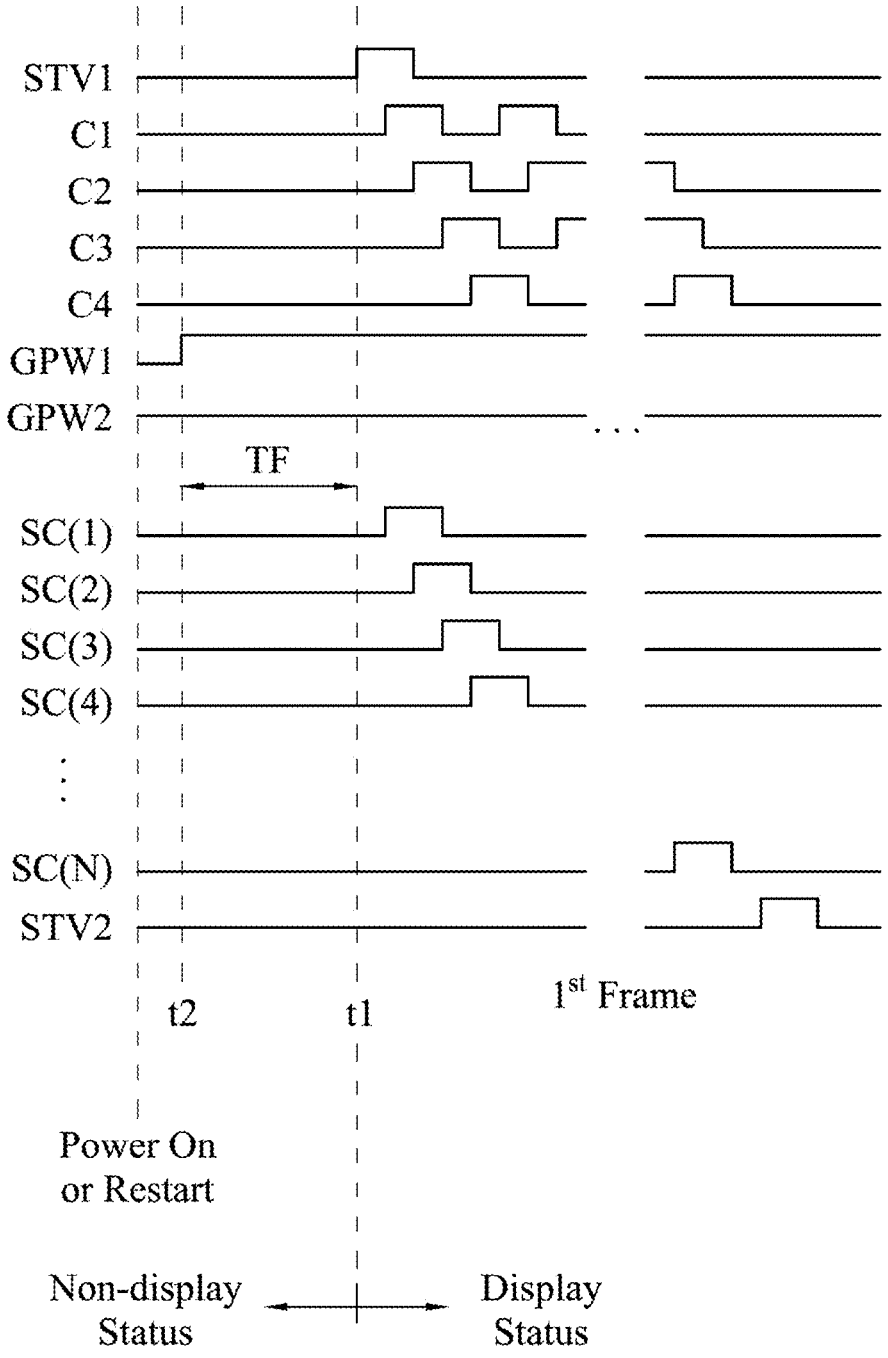
FIG. 8 is another exemplary example of a time sequence diagram of the gate driving circuit in FIG. 2.
Figure 9:
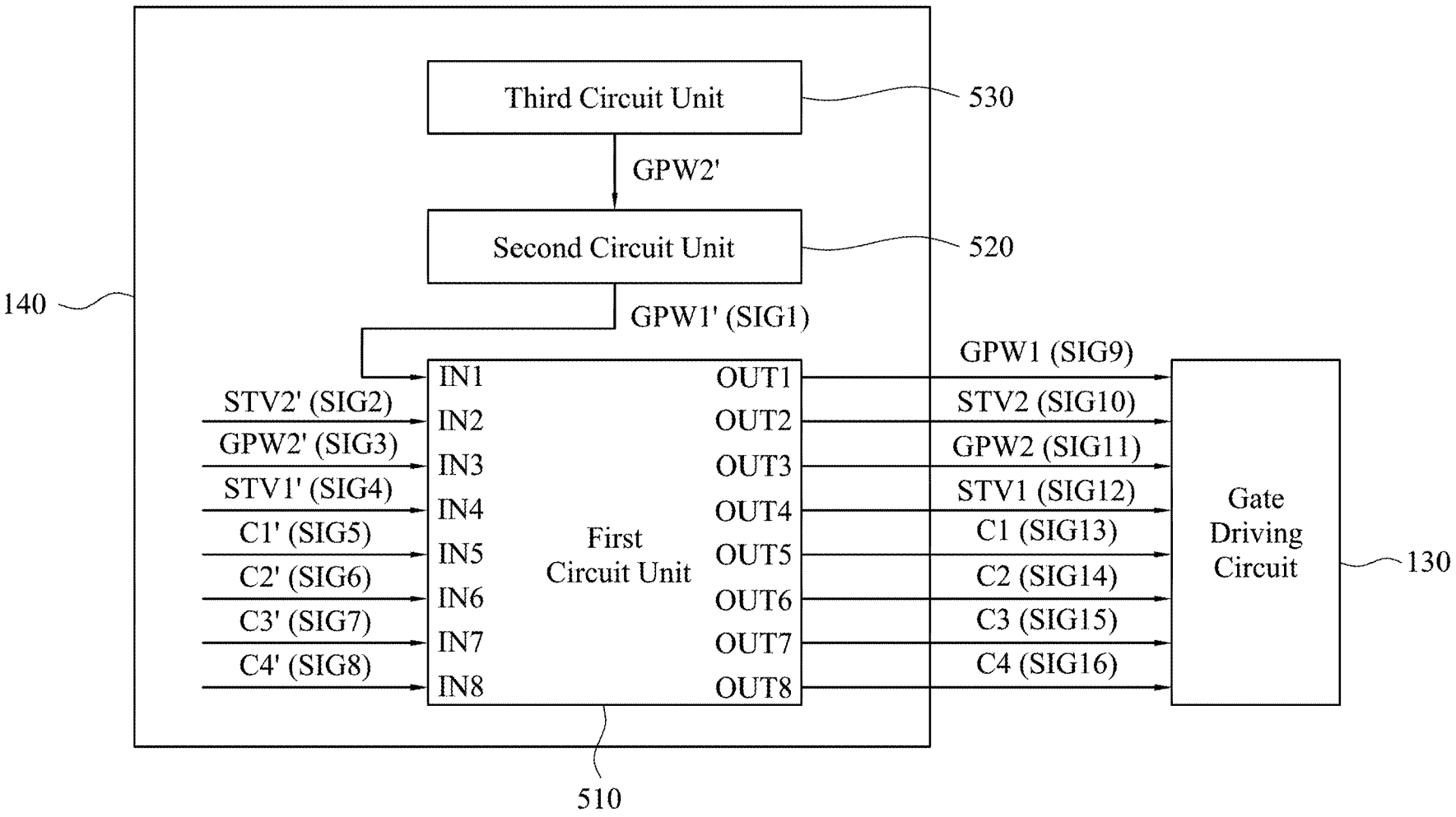
FIG. 9 is another schematic diagram corresponding to the gate driving circuit and the signal generating circuit in FIG. 1.
Figure 10:
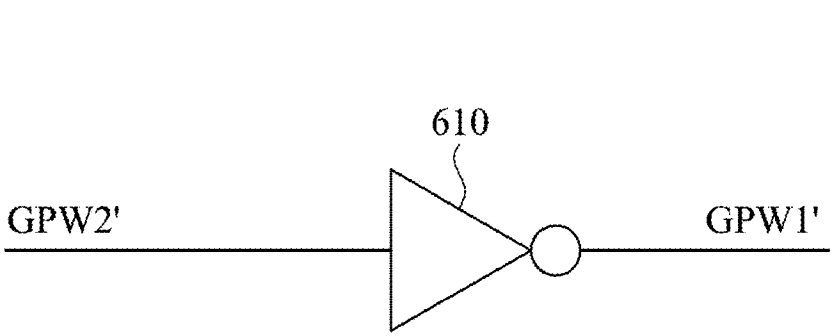
FIG. 10 is an embodiment of the second circuit unit in FIG. 9.

FIGS. 8-10 are schematic diagrams in accordance with another embodiment of the invention, in which FIG. 8 is another exemplary example of a time sequence diagram of the gate driving circuit 200 in FIG. 2, FIG. 9 is another schematic diagram corresponding to the gate driving circuit 130 and the signal generating circuit 140 in FIG. 1, and FIG. 10 is an embodiment of the second circuit unit 520 in FIG. 9. The difference between FIG. 4 and FIG. 8 is, in FIG. 4, the pull-down control signal GPW2 switches from the disabling voltage level to the enabling voltage level before the starting signal STV1 in the first frame period switches from the disabling voltage level to the enabling voltage level to turn on the transistors M4-M9 in the pull-down units 330(2), 330(4), . . . , 330(N) of the even-numbered shift registers 210(2), 210(4), . . . , 210(N), so as to set the nodes X1(1)-X1(N), X2(1)-X2(N) in the shift registers 210(1)-210(N) to be at the disabling voltage level, while in FIG. 8, the pull-down control signal GPW1 switches from the disabling voltage level to the enabling voltage level before the starting signal STV1 in the first frame period switches from the disabling voltage level to the enabling voltage level to turn on the transistors M4-M9 in the pull-down units 330(1), 330(3), . . . , 330(N−1) of the odd-numbered shift registers 210(1), 210(3), . . . , 210(N−1), so as to set the nodes X1(1)-X1(N), X2(1)-X2(N) in the shift registers 210(1)-210(N) to be at the disabling voltage level. In other words, the display device 100 sequentially displays $1^{st}$ to $M^{th}$ frames after the display device 100 is powered on or restarts, M is an integer greater than or equal to 2, the starting signal STV1 in the first frame switches from a disabling voltage level to an enabling voltage level at a first time point t1, the gate driving circuit 130 sequentially outputs the $1^{st}$ to $N^{th}$ stage scan signals SC(1)-SC(N) in the first frame after the starting signal STV1 switches from the disabling voltage level to the enabling voltage level at the first time point t1, the pull-down control signal GPW1 switches from a disabling voltage level to an enabling voltage level at a second time point t2 that is before the first time point t1, and the second time point t2 is before the time point at which the display device displays the first frame. The difference between FIG. 5 and FIG. 9 is, in FIG. 5, the signals receives by the first circuit unit 510 through the $1^{st}$ and $3^{rd}$ input terminals IN1, IN3 are respectively the pull-down control signal GPW2' and the pull-down control signal GPW1', and the signals outputted through the $1^{st}$ and $3^{rd}$ output terminals OUT1, OUT3 are respectively the pull-down control signal GPW2 and the pull-down control signal GPW1, such that the starting signal STV1 in the first frame period switches from the disabling voltage level to the enabling voltage level after the pull-down control signal GPW2 switches from the disabling voltage level to the enabling voltage level, while in FIG. 9, the signals received through the $1^{st}$ and $3^{rd}$ input terminals IN1, IN3 are respectively the pull-down control signal GPW1' and the pull-down control signal GPW2', and the signals outputted through the $1^{st}$ and $3^{rd}$ output terminals OUT1, OUT3 are respectively the pull-down control signal GPW1 and the pull-down control signal GPW2, such that the starting signal STV1 in the first frame period switches from the disabling voltage level to the enabling voltage level after the pull-down control signal GPW1 switches from the disabling voltage level to the enabling voltage level. In addition, in FIG. 5, the third circuit unit 530 provides the pull-down control signal GPW1' to the second circuit unit 520, the second circuit unit 520 converts the pull-down control signal GPW1' into the pull-down control signal GPW2' and provides the pull-down control signal GPW2' to the first circuit unit 510, while in FIG. 9, the third circuit unit 530 provides the pull-down control signal GPW2' to the second circuit unit 520, the second circuit unit 520 converts the pull-down control signal GPW2' into the pull-down control signal GPW1' and provides the pull-down control signal GPW1' to the first circuit unit 510. The difference between FIG. 6 and FIG. 10 is, in FIG. 6, the third circuit unit 530 provides the pull-down control signal GPW1' to the inverter 610, and the inverter 610 converts the pull-down control signal GPW1' into the pull-down control signal GPW2', while in FIG. 10, the third circuit unit 530 provides the pull-down control signal GPW2' to the inverter 610, and the inverter 610 converts the pull-down control signal GPW2' into the pull-down control signal GPW1'.

It is noted that the gate driving circuit in FIG. 2 and the circuits of the shift resisters in FIGS. 3A-3D are merely exemplary examples and are not intended to limit the scope of the invention. In another embodiment, the number of transistors in at least one of the precharge unit, the pull-up unit and the pull-down unit of the shift register and the connections between various transistors may be different from those shown in FIGS. 3A-3D. In some further embodiments, the connections between the signals lines and the shift registers and/or between various shift registers may be different from those shown in FIG. 2. Some variant embodiments of the circuits of the shift register in the invention will be described in the following. For the circuits of the shift registers in FIGS. 3A-3D, each shift register includes a precharge unit, a pull-up unit and a pull-down unit. The odd-numbered shift register 210(*i*) receives the pull-down control signal GPW1, while the even-numbered shift registers 210(*i*+1) receives the pull-down control signal GPW2. The pull-down control signals GPW1, GPW2 are phase-inverted with respect to each other during the display period, and each odd-numbered shift register 210(*i*) and each even-numbered shift register 210(*i*+1) are all coupled to the nodes X1(*i*), X2(*i*), X1(*i*+1), X2(*i*+1), and therefore, when some transistors in one of the pull-down unit 330(*i*) of the odd-numbered shift register 210(*i*) and the pull-down unit 330(*i*+1) of the odd-numbered shift register 210(*i*+1) are enabled to set the nodes X1(*i*), X2(*i*), X1(*i*+1), X2(*i*+1) of the shift registers 210(*i*), 210(*i*+1) to be at the disabling voltage level, some transistors in the other of the pull-down unit 330(*i*) of the odd-numbered shift register 210(*i*) and the pull-down unit 330(*i*+1) of the odd-numbered shift register 210(*i*+1) are disabled, and thus the turning on time of at least some transistors in the pull-down unit 330(*i*) of the shift register 210(*i*) and the pull-down unit 330(*i*+1) of the even-numbered shift register 210(*i*+1) can be shorten for prolonging the lifetime of the gate driving circuit 200.

Figure 11:
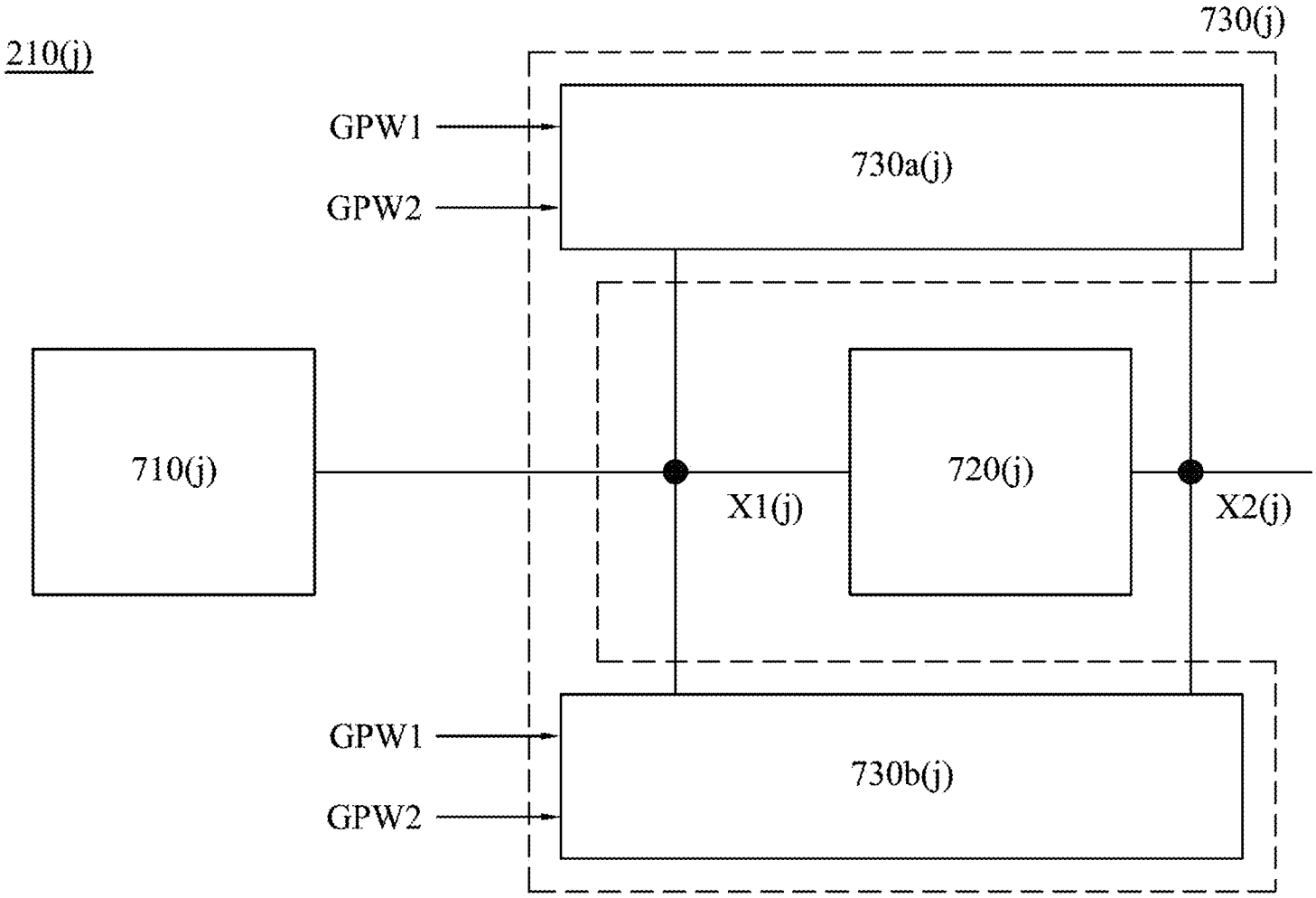
FIG. 11 is an electrical block diagram of a shift register in accordance with another embodiment of the invention.

FIG. 11 is an electrical block diagram of the shift register 210(*j*) in accordance with another embodiment of the invention. The shift register 210(*j*) includes a precharge unit 710(*j*), a pull-up unit 720(*j*) and a pull-down unit 730(*j*), where j is an integer greater than or equal to 1 and less than or equal to N. In comparison with FIGS. 3A-3D in which the pull-down units 330(*i*), 330(*i*+1) of the odd-numbered shift register 210(*i*) and the even-numbered shift register 210(*i*+1) respectively receives the pull-down control signals GPW1, GPW2 and are all coupled to the nodes X1(*i*), X2(*i*) in the shift register 210(*i*) and the nodes X1(*i*+1), X2(*i*+1) in the shift register 210(*i*+1), in FIG. 11, the pull-down unit 730(*j*) of each shift register 210(*j*) receives the pull-down control signals GPW1, GPW2 and is coupled to nodes X1(*j*), X2(*j*) of the shift register 210(*j*). For example, as shown in FIG. 11, the pull-down unit 730(*j*) includes two sub-pull-down units 730*a*(j), 730*b*(j) that are all coupled to the nodes X1(*j*), X2(*j*) and receive the pull-down control signals GPW1, GPW2. The pull-down control signals GPW1, GPW2 are phase-inverted with respect to each other during the display period, and therefore, when the pull-down control signal GPW1 is enabled and the pull-down control signal GPW2 is disabled, or when the pull-down control signal GPW1 is disabled and the pull-down control signal GPW2 is enabled, one the sub-pull-down units 730*a*(j), 730*b*(j) is enabled, and the other of the sub-pull-down units 730*a*(j), 730*b*(j) is disabled. Therefore, the embodiment of FIG. 11 can shorten the turning on time of at least some transistors in the sub-pull-down units 730*a*(j), 730*b*(j) of the shift register 210(*j*), so as to prolong the lifetime of the gate driving circuit 200. In addition, the embodiments of the timing sequence diagram of the gate driving circuit 200 in FIG. 4 or FIG. 8, the gate driving circuit 130 and the signal generating circuit 140 in FIG. 5 or FIG. 9, and the second circuit unit 520 in FIG. 6 or FIG. 10 may be applied to the circuits of the shift register in FIG. 11 in a similar manner, such that the starting signal STV1 in the first frame period switches from the disabling voltage level to the enabling voltage level after the pull-down control signal GPW2 or GPW1 switches from the disabling voltage level to the enabling voltage level, so as to reset the nodes X1(1)-X1(N), X2(1)-X2(N) in the shift registers 210(1)-210(N) before the display device displays the first frame. The following is an exemplary example of the circuit diagram of the shift register 210(*j*) of this embodiment. In the embodiment, the precharge unit 710(*j*) may include a first transistor and a second transistor. The first terminals of the first and second transistors respectively receive a first input signal and a second input signal, the second terminals of the first and second transistors respectively receive reference voltages VH, VL or respectively receive a forward input signal and a backward input signal, and the third terminals of the first and second transistors are coupled to the node X1(*j*) of the shift register 210(*j*). The pre-charge unit 710(*j*) is coupled to the pull-up unit 720(*j*) and outputs the pre-charge signal to the node X1(*j*) based on the first and second input signals. The pull-up unit 720(*j*) may include a third transistor and a capacitor. The first terminal of the third transistor receives the pre-charge signal, the second terminal of the third transistor receives a clock signal, and the third terminal of the third transistor outputs the scan signal. The two terminals of the capacitor are respectively coupled to the first terminal and the third terminal of the third transistor. The sub-pull-down unit 730*a*(j) may include fourth to eighth transistors. The first terminal and the second terminal of the fourth transistor receive the pull-down control signal GPW1. The first terminal of the fifth transistor receives the pull-down control signal GPW2, the second terminal of the fifth transistor receives the reference voltage level VL, and the third terminal of the fifth transistor is coupled to the third terminal of the fourth transistor. The first terminal of the sixth transistor is coupled to the node X1(*j*), the second terminal of the sixth transistor receives the reference voltage level VL, and the third terminal of the sixth transistor is coupled to the third terminals of the fourth and fifth transistors. The first terminal of the seventh transistor is coupled to the third terminal of the sixth transistor, the second terminal of the seventh transistor receives the reference voltage level VL, and the third terminal of the seventh transistor is coupled to the node X1(*j*). The first terminal of the eighth transistor is coupled to the third terminal of the sixth transistor, the second terminal of the eighth transistor receives the reference voltage level VL, and the third terminal of the eighth transistor is coupled to the node X2(*j*). The sub-pull-down unit 730*b*(j) may include ninth to thirteenth transistors. The first terminal and the second terminal of the ninth transistor receive the pull-down control signal GPW2. The first terminal of the tenth transistor receives the pull-down control signal GPW1, the second terminal of the tenth transistor receives the reference voltage level VGL, and the third terminal of the tenth transistor is coupled to the third terminal of the ninth transistor. The first terminal of the eleventh transistor is coupled to the node X1(*j*), the second terminal of the eleventh transistor receives the reference voltage level VL, and the third terminal of the eleventh transistor is coupled to the third terminals of the ninth and tenth transistors. The first terminal of the twelfth transistor is coupled to the third terminal of the eleventh transistor, the second terminal of the twelfth transistor receives the reference voltage level VL, and the third terminal of the twelfth transistor is coupled to the node X1(*j*). The first terminal of the thirteenth transistor is coupled to the third terminal of the eleventh transistor, the second terminal of the thirteenth transistor receives the reference voltage level VL, and the third terminal of the thirteenth transistor is coupled to the node X2(*j*). It is noted that the circuit diagram of the shift register 210(*j*) described above is merely an exemplary example and is not intended to limit the scope of the invention, and the invention does not limit the number of transistors and the connections between various transistors in the precharge unit 710(*j*), the pull-up unit 720(*j*) and the pull-down unit 730(*j*).

Figure 12:
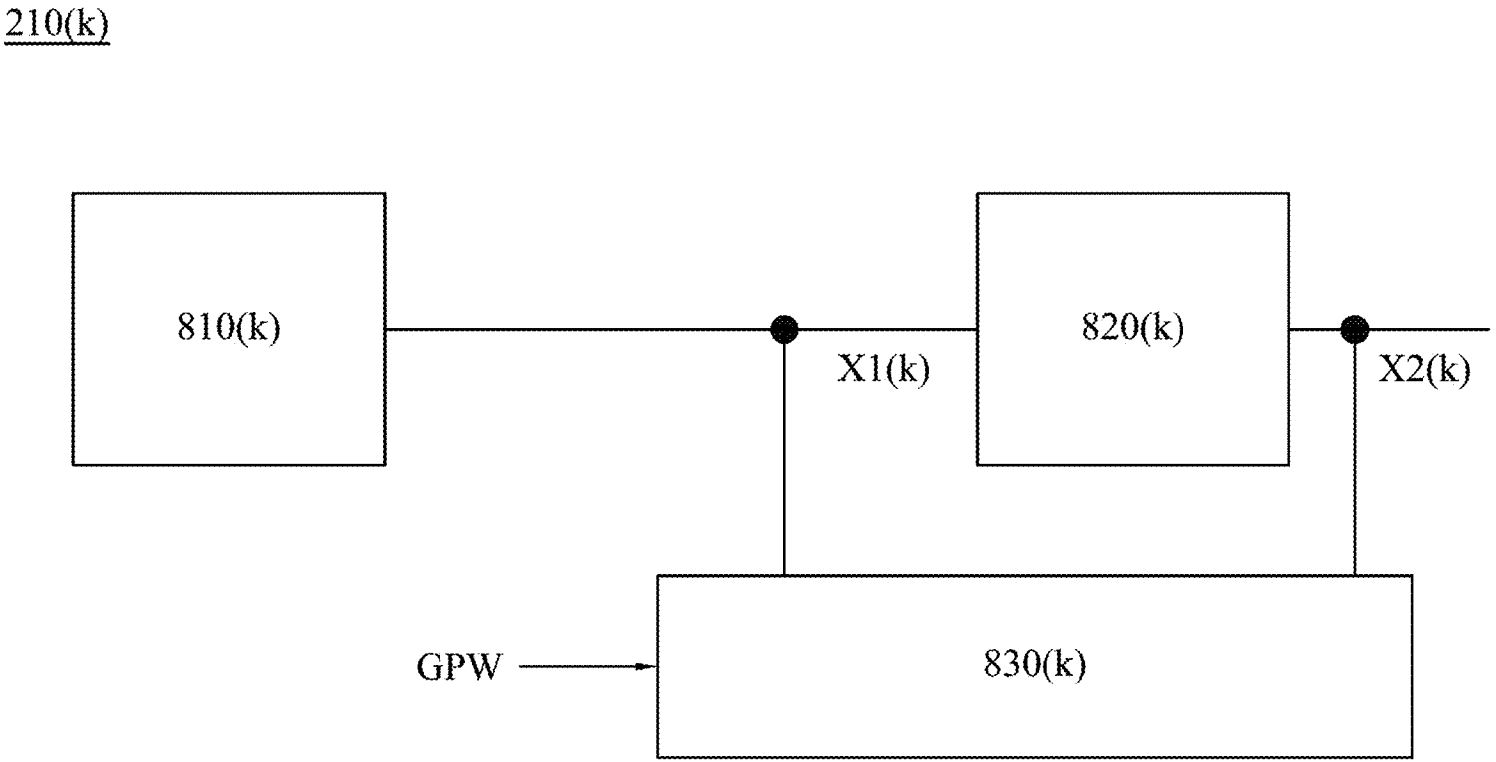
FIG. 12 is an electrical block diagram of a shift register in accordance with a further embodiment of the invention.

FIG. 12 is an electrical block diagram of the shift register 210(*k*) in accordance with a further embodiment of the invention. The shift register 210(*k*) includes a precharge unit 810(*k*), a pull-up unit 820(*k*) and a pull-down unit 830(*k*), where k is an integer greater than or equal to 1 and less than or equal to N. As shown in FIG. 12, the pull-down unit 830(*k*) of the shift register 210(*k*) is coupled to nodes X1(*k*), X2(*k*) and receives the pull-down control signal GPW. When the pull-down control signal GPW is enabled, the pull-down unit 830(*k*) is enabled to reset the nodes X1(1)-X1(N), X2(1)-X2(N) in the shift registers 210(1)-210(N). Similarly, the time point at which the pull-down control signal GPW switches from the disabling voltage level to the enabling voltage level may be set to be prior to the time point at which the starting signal STV1 in the first frame period switches from the disabling voltage level to the enabling voltage level, so as to reset the nodes X1(1)-X1(N), X2(1)-X2(N) in the shift registers 210(1)-210(N) before the display device displays the first frame. In the embodiment, the third circuit unit 530 may provide a signal to the second circuit unit 520, the signal is at the disabling voltage level during a time duration between the time point at which the display device is powered on or restarts and the time point at which the display device displays the first frame, and then the second circuit unit 520 converts the signals into the pull-down control signal GPW which switches from the disabling voltage level to the enabling voltage level after power-on and before the first frame period and remains at the enabling voltage level in the display status, such that the starting signal STV1 in the first frame period switches from the disabling voltage level to the enabling voltage level after the pull-down control signal GPW switches from the disabling voltage level to the enabling voltage level, so as to reset the nodes X1(1)-X1(N), X2(1)-X2(N) of the shift registers 210(1)-210(N) before the display device displays the first frame. Similarly, the invention does not limit the number of transistors and the connections between various transistors in the precharge unit 810(*k*), the pull-up unit 820(*k*) and the pull-down unit 830(*k*).

Summing the above, the signal generating circuit and the display device in accordance with the invention can reset the nodes in the shift registers before image display to prevent the transistors in the shift registers from being interfered by noise to output abnormal scan signals, ensuring normal image display and normal operation of the shift registers.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A signal generating circuit electrically connected to a gate driving circuit of a display device, the gate driving circuit having $1^{st}$ to $N^{th}$ stage shift registers, a starting signal line, a pull-down control signal line and a plurality of clock signal lines, N is an integer greater than or equal to 4, each of the $1^{st}$ to $N^{th}$ stage shift registers having a main circuit unit and a discharge circuit unit, wherein the main circuit unit of each of the $1^{st}$ to $N^{th}$ stage shift registers includes a precharge unit and a pull-up unit, the precharge unit is configured to output a precharge signal to a first node, the pull-up unit is coupled to the precharge unit and is configured to receive the precharge signal, the pull-up unit is configured to output a scan signal to a second node, the pull-up unit includes a transistor, a first terminal of the transistor is coupled to the first node, a second terminal of the transistor is electrically connected to a corresponding clock signal line of the clock signal lines, and a third terminal of the transistor is coupled to the second node and is configured to output the scan signal, the discharge circuit units of at least some of the $1^{st}$ to $N^{th}$ stage shift registers are electrically connected to the pull-down control signal line, and the precharge unit of the main circuit unit of the $1^{st}$ stage shift register of the $1^{st}$ to $N^{th}$ stage shift registers is electrically connected to the starting signal line, the signal generating circuit comprising a timing controller, an inverter and a level shifter, the inverter having an input node and an output node, the level shifter having a starting signal input terminal, a pull-down control signal input terminal, a plurality of clock signal input terminals, a starting signal output terminal, a pull-down control signal output terminal and a plurality of clock signal output terminals, the timing controller being coupled to the input node of the inverter and the starting signal input terminal and the clock signal input terminals of the level shifter, the output node of the inverter being coupled to the pull-down control signal input terminal of the level shifter, and the starting signal output terminal, the pull-down control signal output terminal and the clock signal output terminals of the level shifter being coupled to the starting signal line, the pull-down control signal line and the clock signal lines, respectively;

wherein:

the timing controller is configured to provide a first pull-down control signal, a first starting signal and a plurality of first clock signals respectively to the input node of the inverter and the starting signal input terminal and the clock signal input terminals of the level shifter;

the inverter is configured to convert the first pull-down control signal into another first pull-down control signal and transmit the another first pull-down control signal to the pull-down control signal input terminal of the level shifter, and the another first pull-down control signal is phase-inverted to the first pull-down control signal and is a triggering signal of the level shifter, wherein after the display device is powered on or restarts and before the display device displays a first frame, the first pull-down control signal is at a disabling voltage level, and the inverter converts the first pull-down control signal having the disabling voltage level into the another first pull-down control signal having an enabling voltage level;

the level shifter is configured to convert the another first pull-down control signal, the first starting signal and the first clock signals respectively into a second pull-down control signal, a second starting signal and a plurality of second clock signals, a voltage level of each of the second pull-down control signal, the second starting signal and the second clock signals is between a gate high voltage and a gate low voltage, and the level shifter is configured to transmit the second pull-down control signal, the second starting signal and the second clock signals respectively to the pull-down control signal output terminal, the starting signal output terminal and the clock signal output terminals, wherein after the display device is powered on or restarts, the second starting signal switches from a disabling voltage level to an enabling voltage level at a first time point, and the second pull-down control signal switches from a disabling voltage level to an enabling voltage level at a second time point that is before the first time point;

the pull-down control signal line is configured to receive the second pull-down control signal through the pull-down control signal output terminal of the level shifter and transmit the second pull-down control signal to the discharge circuit units of the at least some of the $1^{st}$ to $N^{th}$ stage shift registers;

the starting signal line is configured to receive the second starting signal through the starting signal output terminal of the level shifter and transmit the second starting signal to the precharge unit of the main circuit unit of the $1^{st}$ stage shift register of the $1^{st}$ to $N^{th}$ stage shift registers; and the clock signal lines are configured to receive the second clock signals through the clock signal output terminals of the level shifter and transmit the second clock signals to the pull-up units of the main circuit units of the $1^{st}$ to $N^{th}$ stage shift registers.

2. The signal generating circuit of claim 1, wherein a duration from the first time point to the second time point is greater than or equal to 50 milliseconds and less than or equal to 1 second.

3. The signal generating circuit of claim 1, wherein in each of the $1^{st}$ to $N^{th}$ stage shift registers, the discharge circuit unit is coupled to the first node and the second node.

4. The signal generating circuit of claim 3, wherein the second pull-down control signal is configured to reset the first node and second node in each of the $1^{st}$ to $N^{th}$ stage shift registers after the display device is powered on or restarts and before the display device displays the first frame.

5. The signal generating circuit of claim 1, wherein the display device sequentially displays $1^{st}$ to $M^{th}$ frames after the display device is powered on or restarts, M is an integer greater than or equal to 2, and the second time point is before a third time point at which the display device displays the first frame.

6. The signal generating circuit of claim 5, wherein the gate driving circuit sequentially output a plurality of scan signals in the first frame after the second starting signal switches from the disabling voltage level to the enabling voltage level at the first time point.

7. The signal generating circuit of claim 1, wherein the gate driving circuit further comprises another pull-down control signal line, the level shifter further comprises another pull-down control signal input terminal and another pull-down control signal output terminal, the another pull-down control signal line is coupled to the another pull-down control signal output terminal, the timing controller is further configured to provide the first pull-down control signal to the another pull-down control signal input terminal of the level shifter, the level shifter is further configured to convert the first pull-down control signal into another second pull-down control signal having a voltage level between the gate high voltage and the gate low voltage and transmit the another second pull-down control signal to the another pull-down control signal line through the another pull-down control signal output terminal;

wherein the discharge circuit units of the odd-numbered stage shift registers of the $1^{st}$ to $N^{th}$ stage shift registers and the discharge circuit units of the even-numbered stage shift registers of the $1^{st}$ to $N^{th}$ stage shift registers are respectively coupled to the pull-down control signal line and the another pull-down control signal line and configured to receive the second pull-down control signal through the pull-down control signal line and the another second pull-down control signal through the another pull-down control signal line, or alternatively the discharge circuit units of the even-numbered stage shift registers of the $1^{st}$ to $N^{th}$ stage shift registers and the discharge circuit units of the odd-numbered stage shift registers of the $1^{st}$ to $N^{th}$ stage shift registers are respectively coupled to the pull-down control signal line and the another pull-down control signal line and configured to receive the second pull-down control signal through the pull-down control signal line and the another second pull-down control signal through the another pull-down control signal line.

8. The signal generating circuit of claim 7, wherein the another second pull-down control signal is at a disabling voltage level before the first time point.

9. The signal generating circuit of claim 7, wherein the second pull-down control signal and the another second pull-down control signal are phase-inverted with respect to each other during a frame of the display device.

10. The signal generating circuit of claim 1, wherein the discharge circuit unit of each of the $1^{st}$ to $N^{th}$ stage shift registers is configured to receive the second pull-down control signal.

11. The signal generating circuit of claim 10, wherein the level shifter is configured to further output another second pull-down control signal to the gate driving circuit, and the discharge circuit unit of each of the $1^{st}$ to $N^{th}$ stage shift registers is configured to receive the another pull-down control signal.

12. The signal generating circuit of claim 11, wherein the another second pull-down control signal is at a disabling voltage level before the first time point.

13. The signal generating circuit of claim 11, wherein the second pull-down control signal and the another second pull-down control signal are phase-inverted with respect to each other during a frame of the display device.

14. The signal generating circuit of claim 1, wherein the gate driving circuit further comprises an ending signal line, the precharge unit of the main circuit unit of the $N^{th}$ stage shift register of the $1^{st}$ to $N^{th}$ stage shift registers is electrically connected to the ending signal line, the level shifter further comprises an ending signal input terminal and an ending signal output terminal, the ending signal line is coupled to the ending signal output terminal, the timing controller is further configured to provide a first ending signal to the ending signal input terminal of the level shifter, the level shifter is further configured to convert the first ending signal into a second ending signal having a voltage level between the gate high voltage and the gate low voltage and transmit the second ending signal to the ending signal line through the ending signal output terminal.

15. The signal generating circuit of claim 1, wherein the clock signal lines comprise first to fourth clock signal lines, the first to fourth clock signal lines are respectively coupled to the $1^{st}$ to $4^{th}$ stage shift registers of $1^{st}$ to $N^{th}$ stage shift registers.

16. The signal generating circuit of claim 1, wherein the display device comprises a display panel, the display panel comprises an active matrix substrate, the gate driving circuit is a gate on array (GOA) structure disposed on the active matrix substrate, and the signal generating circuit is not disposed on the active matrix substrate.

17. The signal generating circuit of claim 16, wherein the display device further comprises a source driving circuit, the display panel further comprises a plurality of data lines disposed on the active matrix substrate, the source driving circuit is electrically connected to the data lines, and the timing controller is coupled to the source driving circuit.

18. A display device, comprising:

a substrate;

a plurality of scan lines and a plurality of data lines disposed on the substrate;

a gate driving circuit electrically connected to at least some of the scan lines, the gate driving circuit comprising:

a starting signal line;

a pull-down control signal line;

a plurality of clock signal lines; and $1^{st}$ to $N^{th}$ stage shift registers, N is an integer greater than or equal to 4, each of the $1^{st}$ to $N^{th}$ stage shift registers having a main circuit unit and a discharge circuit unit, wherein the main circuit unit of each of the $1^{st}$ to $N^{th}$ stage shift registers includes a precharge unit and a pull-up unit, the precharge unit is configured to output a precharge signal to a first node, the pull-up unit is coupled to the precharge unit and is configured to receive the precharge signal, the pull-up unit is configured to output a scan signal to a second node, the pull-up unit includes a transistor, a first terminal of the transistor is coupled to the first node, a second terminal of the transistor is electrically connected to a corresponding clock signal line of the plurality of clock signal lines, and a third terminal of the transistor is coupled to the second node and is configured to output the scan signal, the discharge circuit units of at least some of the $1^{st}$ to $N^{th}$ stage shift registers are electrically connected to the pull-down control signal line, and wherein the precharge unit of the main circuit unit of the $1^{st}$ stage shift register of the $1^{st}$ to $N^{th}$ stage shift registers is electrically connected to the starting signal line; and a signal generating circuit electrically connected to the gate driving circuit, the signal generating circuit comprising:

an inverter having an input node and an output node;

a level shifter having a starting signal input terminal, a pull-down control signal input terminal, a plurality of clock signal input terminals, a starting signal output terminal, a pull-down control signal output terminal and a plurality of clock signal output terminals, the pull-down control signal input terminal of the level shifter being coupled to the output node of the inverter, and the starting signal output terminal, the pull-down control signal output terminal and the clock signal output terminals of the level shifter being coupled to the starting signal line, the pull-down control signal line and the clock signal lines, respectively; and a timing controller coupled to the input node of the inverter and the starting signal input terminal and the clock signal input terminals of the level shifter, wherein the timing controller is configured to provide a first pull-down control signal, a first starting signal and a plurality of first clock signals respectively to the input node of the inverter and the starting signal input terminal and the clock signal input terminals of the level shifter;

wherein:

the inverter is configured to convert the first pull-down control signal into another first pull-down control signal and transmit the another first pull-down control signal to the pull-down control signal input terminal of the level shifter, and the another first pull-down control signal is phase-inverted to the first pull-down control signal and is a triggering signal of the level shifter, wherein after the display device is powered on or restarts and before the display device displays a first frame, the first pull-down control signal is at a disabling voltage level, and the inverter converts the first pull-down control signal having the disabling voltage level into the another first pull-down control signal having an enabling voltage level;

the level shifter is configured to convert the another first pull-down control signal, the first starting signal and the first clock signals respectively into a second pull-down control signal, a second starting signal and a plurality of second clock signals, a voltage level of each of the second pull-down control signal, the second starting signal and the second clock signals is between a gate high voltage and a gate low voltage, and the level shifter is configured to transmit the second pull-down control signal, the second starting signal and the second clock signals respectively to the pull-down control signal output terminal, the starting signal output terminal and the clock signal output terminals, wherein after the display device is powered on or restarts, the second starting signal switches from a disabling voltage level to an enabling voltage level at a first time point, and the second pull-down control signal switches from a disabling voltage level to an enabling voltage level at a second time point that is before the first time point;

the pull-down control signal line is configured to receive the second pull-down control signal through the pull-down control signal output terminal of the level shifter and transmit the second pull-down control signal to the discharge circuit units of the at least some of the $1^{st}$ to $N^{th}$ stage shift registers;

the starting signal line is configured to receive the second starting signal through the starting signal output terminal of the level shifter and transmit the second starting signal to the precharge unit of the main circuit unit of the $1^{st}$ stage shift register of the $1^{st}$ to $N^{th}$ stage shift registers; and the clock signal lines are configured to receive the second clock signals through the clock signal output terminals of the level shifter and transmit the second clock signals to the pull-up units of the main circuit units of the $1^{st}$ to $N^{th}$ stage shift registers.

19. The display device of claim 18, wherein the gate driving circuit is a gate on array (GOA) structure.

* * * * *